US007442282B2

(12) United States Patent
Makino et al.

(10) Patent No.: US 7,442,282 B2
(45) Date of Patent: Oct. 28, 2008

(54) ELECTROLYTIC PROCESSING APPARATUS AND METHOD

(75) Inventors: Natsuki Makino, Tokyo (JP); Junji Kunisawa, Tokyo (JP)

(73) Assignee: Ebara Corporation, Tokyo (JP)

( * ) Notice: Subject to any disclaimer, the term of this patent is extended or adjusted under 35 U.S.C. 154(b) by 310 days.

(21) Appl. No.: 10/724,044

(22) Filed: Dec. 1, 2003

(65) Prior Publication Data

US 2004/0129576 A1 Jul. 8, 2004

(30) Foreign Application Priority Data

Dec. 2, 2002 (JP) ..... 2002-350529

(51) Int. Cl.

| | |
|---|---|
| ***C25D 17/00*** | (2006.01) |
| ***C25F 7/00*** | (2006.01) |
| ***B23H 5/06*** | (2006.01) |
| *C25D 7/12* | (2006.01) |
| *C25F 3/12* | (2006.01) |

(52) U.S. Cl. ..... 204/224 M; 204/225

(58) Field of Classification Search ..... None
See application file for complete search history.

(56) References Cited

U.S. PATENT DOCUMENTS 6,176,992 B1 * 1/2001 Talieh ..... 205/87
6,375,823 B1 * 4/2002 Matsuda et al. ..... 205/117
2001/0024691 A1 * 9/2001 Kimura et al. ..... 427/346
2002/0130049 A1 * 9/2002 Chen et al. ..... 205/640

* cited by examiner

*Primary Examiner*—Harry D Wilkins, III
(74) *Attorney, Agent, or Firm*—Wenderoth, Lind & Ponack, L.L.P.

(57) ABSTRACT

An electrolytic processing apparatus according to an embodiment of the present invention includes: a substrate holder for holding a substrate; a first electrode to make contact with the substrate for passing electricity to a processing surface of the substrate; an electrode head including a high resistance structure and a second electrode, disposed opposite to and in this order from the substrate holder, and a polishing surface facing the processing surface of the substrate held by the substrate holder; an electrolytic solution injection portion for injecting an electrolytic solution between the processing surface of the substrate held by the substrate holder and the second electrode; a relative movement mechanism for moving the substrate holder and the electrode head relative to each other; a press mechanism for pressing the polishing surface of the electrode head against the substrate held by the substrate holder; and a power source for applying a voltage between the first electrode and the second electrode. The power source is capable of selectively switching the direction of electric current.

21 Claims, 22 Drawing Sheets

ELECTROLYTIC PROCESSING APPARATUS AND METHOD

BACKGROUND OF THE INVENTION

1. Field of the Invention

The present invention relates to an electrolytic processing apparatus and method, and more particularly to an electrolytic processing apparatus and method for filling a metal such as copper (Cu) or the like in fine interconnection patterns (recesses) formed in a semiconductor substrate.

2. Description of the Related Art

In recent years, instead of using aluminum or aluminum alloys as a material for forming interconnection circuits on a semiconductor substrate, there is an eminent movement towards using copper (Cu) that has a low electric resistivity and high electromigration endurance. Copper interconnects are generally formed by filling copper into fine recesses formed in the surface of a substrate. There are known various techniques for forming such copper interconnects, including CVD, sputtering, and plating. According to any such technique, a copper film is formed in the substantially entire surface of a substrate, followed by removal of unnecessary copper by performing chemical mechanical polishing (CMP).

FIGS. 22A through 22C illustrate, in sequence of process steps, an example of forming such a substrate W having copper interconnects. As shown in FIG. 22A, an insulating film 2, such as a silicon oxide film of $SiO_2$ or a film of low-k material, is deposited on a conductive layer 1*a* in which electronic devices are formed, which is formed on a semiconductor base 1. A contact hole 3 and a trench 4 for interconnects are formed in the insulating film 2 by performing a lithography/etching technique. Thereafter, a barrier layer 5 of TaN or the like is formed on the entire surface, and a seed layer 7 as an electric supply layer for electroplating is formed on the barrier layer 5.

Then, as shown in FIG. 22B, copper plating is performed onto a surface of the substrate W to fill the contact hole 3 and the trench 4 with copper and, at the same time, deposit a copper film 6 on the insulating film 2. Thereafter, the copper film 6 and the barrier layer 5 on the insulating film 2 are removed by performing chemical mechanical polishing (CMP) so as to make the surface of the copper filled in the contact hole 3 and the trench 4 for interconnects and the surface of the insulating film 2 lie substantially on the same plane. Interconnects composed of the copper film 6 as shown in FIG. 22C are thus formed.

By the way, as shown in FIG. 23, when the copper film 6 is formed by performing plating on the surface of the substrate W in which a fine groove(s) 8 with a width $d_1$, e.g., of the order of 0.1 μm, and a large groove(s) 9 with a width $d_2$, e.g., of the order of 100 μm are present, the growth of plating is likely to be promoted at the portion above the fine groove 8 whereby the copper film 6 is raised at that portion, even when the effect of a plating solution or an additive contained in the plating solution is optimized, whereas the growth of plating with an adequately high leveling property cannot be made within the large groove 9. This results in a difference (a+b) in the level of the copper film 6 deposited on the substrate W, i.e. the height a of the raised portion above the fine groove 8 plus the depth b of the depressed portion above the large groove 9. Thus, in order to obtain the desired flat surface of substrate W with the fine groove 8 and the large groove 9 being fully filled with copper, it is necessary to provide the copper film 6 having a sufficiently large thickness beforehand, and remove by performing CMP the extra portion corresponding to the above difference (a+b) in the level.

This involves problems that the large thickness of the plated film requires a prolonged time for processing by CMP in order to polish away the large amount. Increasing the rate of CMP processing to avoid the prolongation of processing time can cause dishing in the large groove.

In order to solve these problems, it is necessary to make the thickness of a plated film as thin as possible, and reduce or eliminate the raised portions and recesses in the plated film even when fine grooves and large grooves are co-present in the surface of a substrate to thereby improve the flatness of the plated film. At present, however, when performing plating using, for example, a copper sulfate plating bath, it is not possible to simultaneously decrease the raised portions and decrease the recesses solely by the action of the plating solution or an additive. It is possible to reduce the raised portions by temporarily using a reverse voltage during plating or using a PR pulse power source as a plating power source. This method, however, is not effective in decreasing the recesses and, in addition, deteriorates the quality of the surface of the plated film.

Further, a chemical/mechanical/electrical polishing method, in which CMP processing and plating are carried out simultaneously, has been proposed. This method involves mechanical processing of the growing surface of plating, which includes an abnormal growth of plating, leading to a poor film quality.

SUMMARY OF THE INVENTION

The present invention has been made in view of the above situation in the related art. It is therefore an object of the present invention to provide an electrolytic processing apparatus and method that can improve the flatness of a plated film formed on a substrate even when fine grooves and large grooves are co-present in the surface of the substrate, enabling a later CMP processing to be carried out in a short time while preventing dishing during the CMP processing.

In order to achieve the above object, the present invention provides an electrolytic processing apparatus, comprising: a substrate holder for holding a substrate; a first electrode to make contact with the substrate for passing electricity to a processing surface of the substrate; an electrode head including a high resistance structure and a second electrode, disposed opposite to and in this order from the substrate holder, and a polishing surface facing the processing surface of the substrate held by the substrate holder; an electrolytic solution injection portion for injecting an electrolytic solution between the processing surface of the substrate held by the substrate holder and the second electrode; a relative movement mechanism for moving the substrate holder and the electrode head relative to each other; a press mechanism for pressing the polishing surface of the electrode head against the substrate held by the substrate holder; and a power source for applying a voltage between the first electrode and the second electrode, said power source being capable of selectively switching the direction of electric current.

According to the electrolytic processing apparatus, electroplating can be carried out by using the first electrode as a cathode and the second electrode as an anode, while electrolytic etching can be carried out by reversing the direction of electric current by the power source, that is, using the first electrode as an anode and the second electrode as a cathode. By carrying out the electrolytic etching by pressing the polishing surface against the processing surface (plating surface) of a substrate while moving the polishing surface and the substrate relative to each other, it becomes possible, for example, to rub away a thin film at the topmost layer of a raised portion in a plated film, which raised portion may be formed over a fine groove, and selectively etch away the exposed layer of the plated film, thereby improving the flatness of the plated film.

In a preferred embodiment of the present invention, the polishing surface comprises an exposed surface of a polishing pad attached to the substrate-facing surface of the high resistance structure.

In a preferred embodiment of the present invention, the polishing surface comprises an exposed surface of a polishing pad supported by a support.

By holding the polishing pad by a support that may be of any shape and any material, the polishing pad can be easily held and disposed in a predetermined position.

The polishing pad is preferably made of a flexible and durable woven fabric, non-woven fabric, resin or resin foam.

A preferred woven or non-woven fabric may be one that has continuous fine pores that can hold an electrolytic solution within the pad against gravity and permits passage therethrough of the electrolytic solution to pass electricity. In the case of a fabric having no such continuous pores, it is possible to provide the polishing pad with vertically-extending small thorough-holes.

In a preferred embodiment of the present invention, the polishing surface comprises the lower surface of the high resistance structure which has undergone partial or entire modification or surface treatment.

The modification or surface treatment may, for example, be coating, firing or sealing of part or the whole of the high resistance structure.

Preferably, the press mechanism is capable of adjusting a pressing force applied to the processing surface of the substrate by the biasing force of a spring element.

As the spring element, besides a solid elastic body such as a helical spring, a fluid elastic body using compressed air may be used. Thus, the press mechanism may be comprised of a helical spring and a servomotor. Alternatively, the press mechanism may be constructed by using an actuator for adjusting air pressure.

The electrolytic solution may be a plating solution or a solution of a plating solution containing an acidic solution.

This makes it possible to carry out electroplating using a plating solution, e.g. a copper sulfate plating solution, and carry out electrolytic etching using the plating solution as an etching solution without changing the electrolytic solution.

The present invention also provides another electrolytic processing apparatus, comprising: a substrate holder for holding a substrate with its processing surface facing upward; a first electrode to make contact with the substrate for passing electricity to the processing surface of the substrate; an electrode head including a high resistance structure and a second electrode disposed above the high resistance structure, both disposed above the substrate holder, and a polishing surface facing the processing surface of the substrate held by the substrate holder; an electrolytic solution injection portion for injecting an electrolytic solution between the processing surface of the substrate held by the substrate holder and the second electrode; a relative movement mechanism for moving the substrate holder and the electrode head relative to each other; a press mechanism for pressing the polishing surface of the electrode head against the substrate held by the substrate holder; and a power source for applying a voltage between the first electrode and the second electrode, said power source being capable of selectively switching the direction of electric current.

The present invention also provides yet another electrolytic processing apparatus, comprising: a substrate holder for holding a substrate; a first electrode to make contact with the substrate for passing electricity to a processing surface of the substrate; a first electrode head and a second electrode head each including a high resistance structure and a second electrode disposed above the high resistance structure, both disposed above the substrate holder; and a first electrolytic solution tray and a second electrolytic solution tray respectively for holding a first electrolytic solution and a second electrolytic solution having different properties, wherein the processing surface of the substrate held by the substrate holder is subjected to a first electrolytic processing using the first electrolytic solution and the first electrode head, and a second electrolytic processing using the second electrolytic solution and the second electrode head.

According to the electrolytic processing apparatus, the first electrolytic processing of a substrate using the first electrolytic solution and the second electrolytic processing of the substrate using the second electrolytic solution can be carried out successively while the substrate is kept held by the substrate holder without transfer of the substrate.

Preferably, at least one of the first electrode head and the second electrode head further includes a polishing surface facing the processing surface of the substrate held by the substrate holder, and a press mechanism for pressing the polishing surface against the substrate held by the substrate holder.

The first electrode head and the second electrode head may be comprised of a single electrode head.

The use of a single electrode head can simplify the structure.

The first and second electrolytic solutions may be plating solutions having different compositions.

For example, a plating solution having a high copper sulfate concentration and a low sulfuric acid concentration and having excellent embedding properties may be used as the first electrolytic solution, and a plating solution having a low copper sulfate concentration and a high sulfuric acid concentration and having excellent plated film-flattening properties may be used as the second electrolytic solution. The two types of plating processings of a substrate using the two plating solutions having different properties can be carried out successively while the substrate is kept held by the substrate holder.

Alternatively, at least one of the first and second electrolytic solutions may be an etching solution.

Plating processing and etching processing of a substrate, or etching processings using different electrolytic solutions (etching solutions) of a substrate can be carried out successively while the substrate is kept held by the substrate holder.

The present invention also provides an electrolytic processing method, comprising: holding a substrate while allowing a processing surface of the substrate to be in contact with a first electrode; disposing a high resistance structure and a second electrode opposite to and in this order from the substrate; filling the space between the first electrode and the second electrode with an electrolytic solution and applying a voltage therebetween; carrying out electroplating of the processing surface of the substrate with the first electrode as a cathode and the second electrode as an anode while providing a space above or below the processing surface; and carrying out electrolytic etching of the processing surface of the substrate with the first electrode as an anode and the second electrode as a cathode while rubbing the processing surface of the substrate with a polishing surface.

In a preferred embodiment of the present invention, the electrolytic processing is carried out while moving the substrate and the polishing surface relative to each other.

The present invention also provides another electrolytic processing method, comprising: holding a substrate while allowing a processing surface of the substrate to be in contact with a first electrode; disposing a high resistance structure and a second electrode opposite to and in this order from the substrate; filling the space between the first electrode and the second electrode with an electrolytic solution and applying a voltage therebetween; carrying out electroplating of the processing surface of the substrate with the first electrode as a cathode and the second electrode as an anode while allowing the polishing surface to be in contact with the processing surface of the substrate; and carrying out electrolytic etching of the processing surface of the substrate with the first electrode as an anode and the second electrode as a cathode while rubbing the processing surface of the substrate with a polishing surface.

The present invention also provides yet another electrolytic processing method, comprising: holding a substrate while allowing a processing surface of the substrate to be in contact with a first electrode; disposing a high resistance structure and a second electrode opposite to and in this order from the substrate; filling the space between the first electrode and the second electrode with a first electrolytic solution and applying a voltage therebetween to carry out a first electrolytic processing; disposing a high resistance structure and a second electrode opposite to and in this order from the substrate; and filling the space between the first electrode and the second electrode with a second electrolytic solution and applying a voltage therebetween to carry out a second electrolytic processing.

The first electrolytic processing and the second electrolytic processing may be plating processings using plating solutions having different compositions as the electrolytic solutions.

Alternatively, at least one of the first electrolytic processing and the second electrolytic processing may be an etching processing using an etching solution as the electrolytic solution.

According to the present invention, electroplating can be carried out by using the first electrode as a cathode and the second electrode as an anode, while electrolytic etching can be carried out by reversing the direction of electric current by the power source, that is, using the first electrode as an anode and the second electrode as a cathode. By carrying out the electrolytic etching by pressing the polishing surface against the processing surface (plating surface) of a substrate while moving the polishing surface and the substrate relative to each other, it becomes possible to selectively etch away a raised portion in a plated film, which raised portion may be formed over a fine groove, thereby improving the flatness of the plated film. This enables a later CMP processing to be carried out in a short time while preventing dishing during the CMP processing.

The above and other objects, features, and advantages of the present invention will be apparent from the following description when taken in conjunction with the accompanying drawings that illustrates preferred embodiments of the present invention by way of example.

DETAILED DESCRIPTION OF THE PREFERRED EMBODIMENTS

Preferred embodiments of the present invention will now be described in detail with reference to the drawings. The following embodiments relate to application of the present invention to a substrate processing apparatus adapted for performing copper electroplating and electrolytic etching of the surface of a semiconductor substrate, thereby embedding copper in fine interconnect trenches formed in the substrate surface to form interconnects of the embedded copper film. The present invention, however, is of course applicable to other substrate processing apparatuses.

Figure 1:
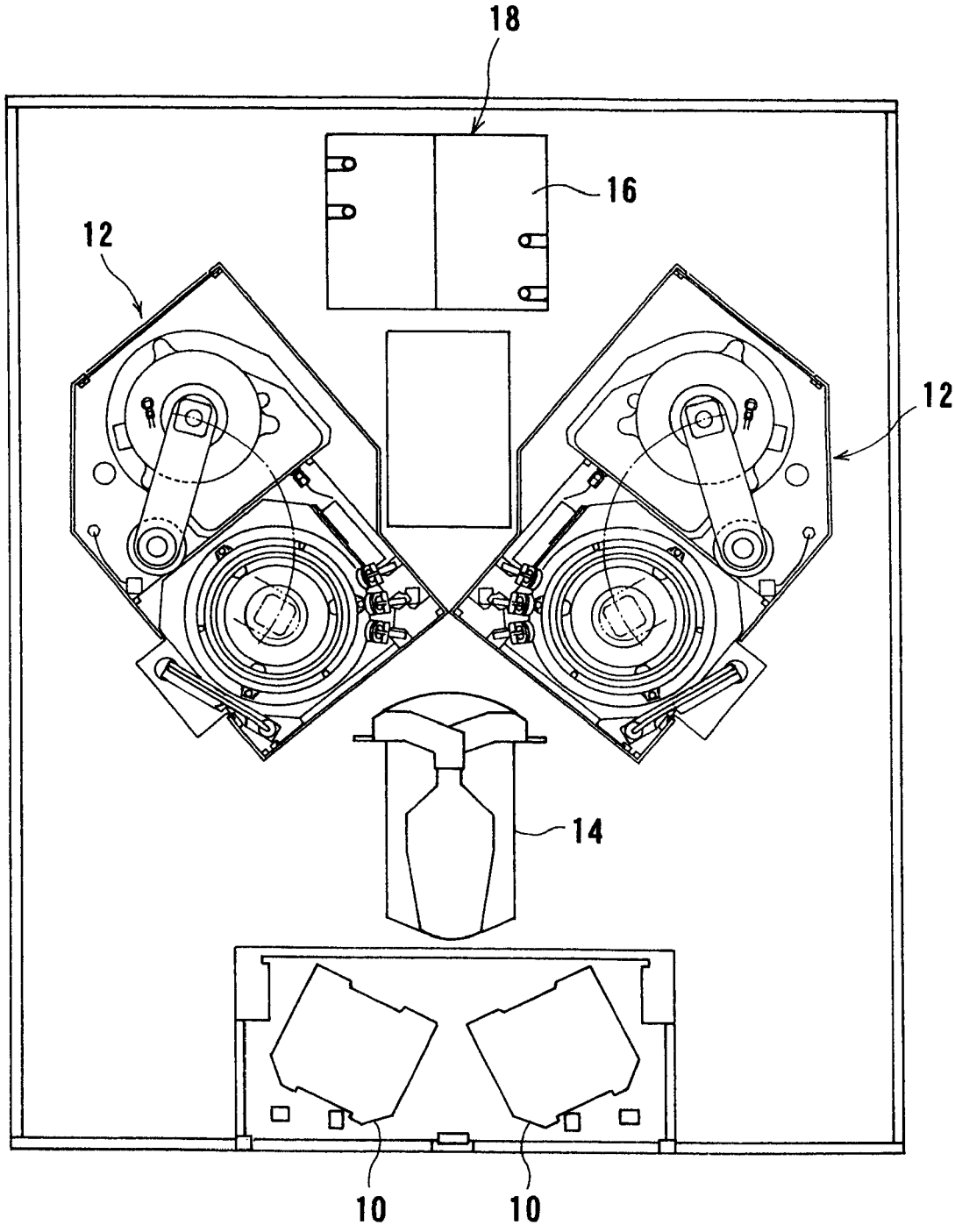
FIG. 1 is a plan view showing a substrate processing apparatus incorporating an electrolytic processing apparatus according to an embodiment of the present invention.

FIG. 1 is a plan view showing a substrate processing apparatus incorporating an electrolytic processing apparatus according to an embodiment of the present invention. As shown in FIG. 1, this substrate processing apparatus has a rectangular facility which houses therein two loading/unloading units 10 for housing a plurality of substrates W therein, two electrolytic processing apparatuses 12 for performing electrolytic processing and processing incidental thereto, a transfer robot 14 for transferring substrates W between the loading/unloading units 10 and the electrolytic processing apparatuses 12, and electrolytic solution supply equipment 18 having a electrolytic solution tank 16.

Figure 2:
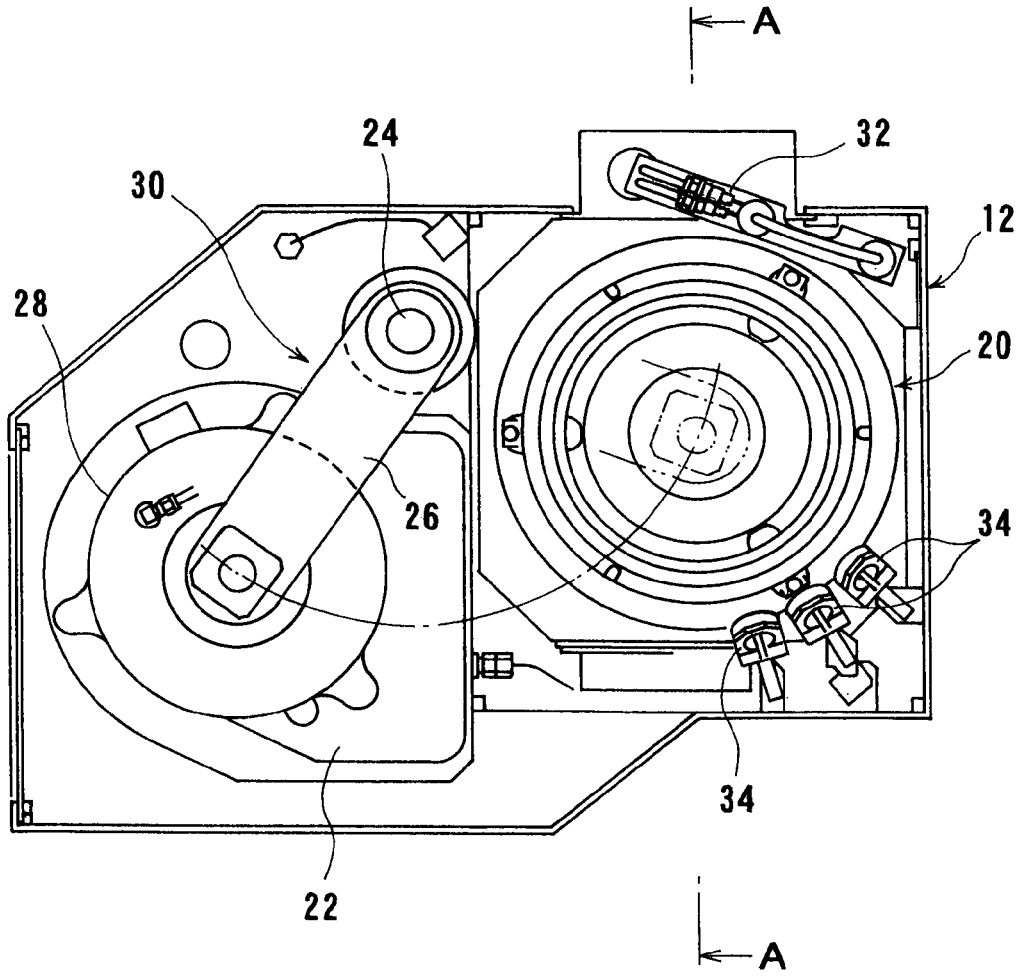
FIG. 2 is a plan view of the electrolytic processing apparatus according to the present invention.

The electrolytic processing apparatus 12, as shown in FIG. 2, is provided with a substrate processing section 20 for performing electrolytic processing and processing incidental thereto, and an electrolytic solution tray 22 for storing an electrolytic solution is disposed adjacent to the substrate processing section 20. There is also provided an electrode arm portion 30 having an electrode head 28 which is held at the front end of an arm 26 swingable about a rotating shaft 24 and which is swung between the substrate processing section 20 and the electrolytic solution tray 22. Furthermore, a pre-coating/recovering arm 32, and fixed nozzles 34 for ejecting pure water or a chemical liquid such as ion water, and further a gas or the like toward a substrate are disposed laterally of the substrate processing section 20. In this embodiment, three of the fixed nozzles 34 are disposed, and one of them is used for supplying pure water.

Figure 3:
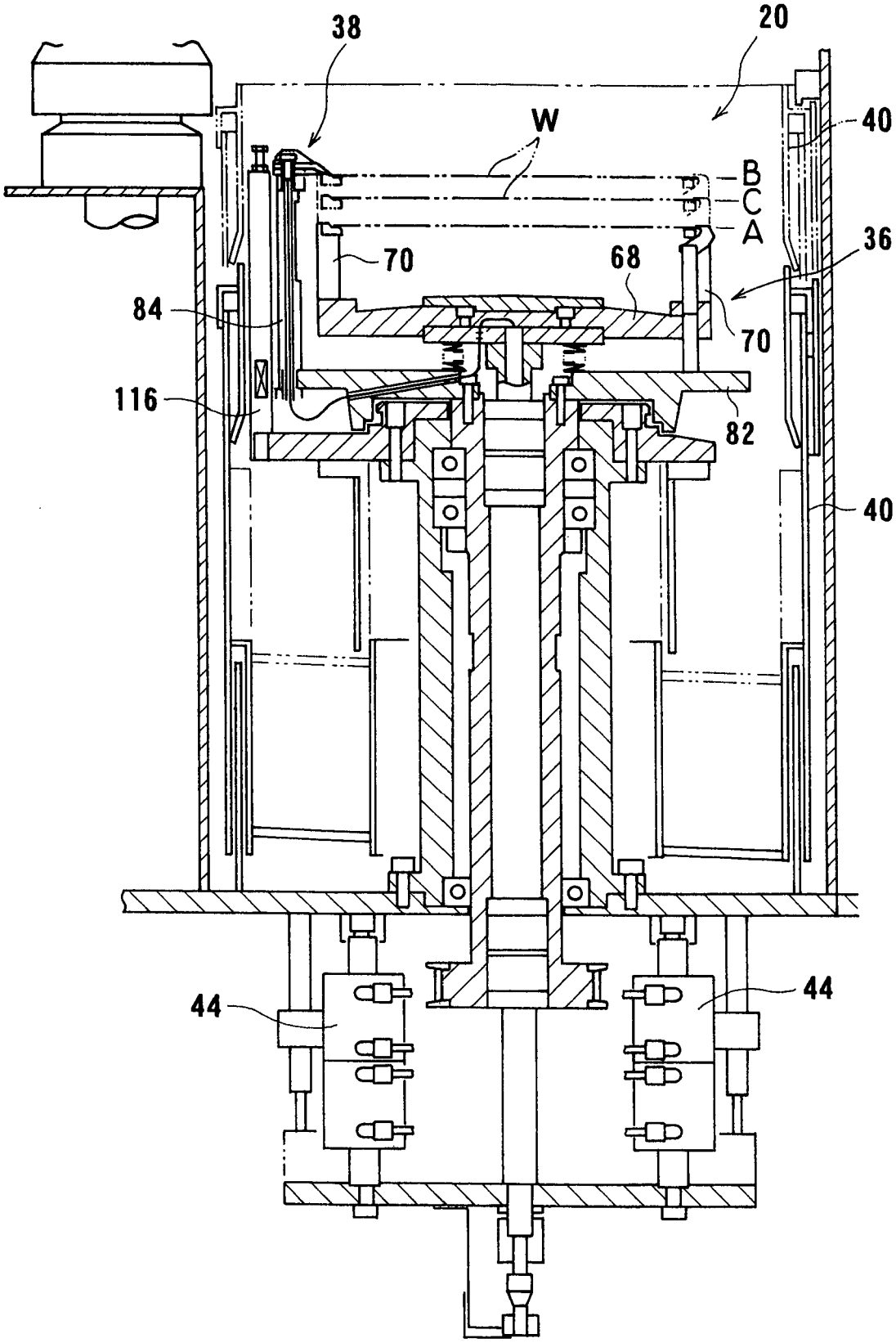
FIG. 3 is an enlarged sectional view of the substrate holder and the electrode portion of the electrolytic processing apparatus.

The substrate processing section 20, as shown in FIG. 3, has a substrate holder 36 for holding a substrate W with its surface (processing surface) facing upward, and a electrode portion 38 located above the substrate holder 36 so as to surround a peripheral portion of the substrate holder 36. Further, a substantially cylindrical bottomed cup 40 surrounding the periphery of the substrate holder 36 for preventing scatter of various chemical liquids used during processing is provided so as to be vertically movable by an air cylinder (not shown).

The substrate holder 36 is adapted to be raised and lowered by the air cylinder 44 between a lower substrate transfer position A, an upper electrolytic processing position B, and a pretreatment/cleaning position C intermediate between these positions. The substrate holder 36 is also adapted to rotate at an arbitrary acceleration and an arbitrary velocity integrally with the electrode portion 38 by a rotating motor and a belt (not shown) Substrate carry-in and carry-out openings (not shown) are provided in confrontation with the substrate transfer position A in a side panel of the electrolytic processing apparatus 12 facing the transfer robot 14. When the substrate holder 36 is raised to the electrolytic processing position B, a sealing member 90 and first electrodes 88 (to be described below) of the electrode portion 38 are brought into contact with the peripheral edge portion of the substrate W held by the substrate holder 36. On the other hand, the cup 40 has an upper end located below the substrate carry-in and carry-out openings, and when the cup 40 ascends, the upper end of the cup 40 reaches a position above the electrode portion 38 closing the substrate carry-in and carry-out openings, as shown by imaginary lines in FIG. 3.

The electrolytic solution tray 22 serves to wet a high resistance structure 110 and a second electrode 98 (to be described later on) of the electrode arm portion 30 with an electrolytic solution, when electrolytic processing has not been performed. The electrolytic solution tray 22 is set at a size in which the high resistance structure 110 can be accommodated, and the electrolytic solution tray 22 has an electrolytic solution supply port and an electrolytic solution drainage port (not shown). A photo-sensor is attached to the electrolytic solution tray 22, and can detect brimming with the electrolytic solution in the electrolytic solution tray 22, i.e., overflow, and drainage.

The electrode arm portion 30 is vertically movable by a vertical movement motor 132, which is a servomotor, and a ball screw 134, and swingable between the electrolytic solution tray 22 and the substrate processing section 20 by a swing motor, in this embodiment, as described below. A compressed actuator may be used.

Figure 4:
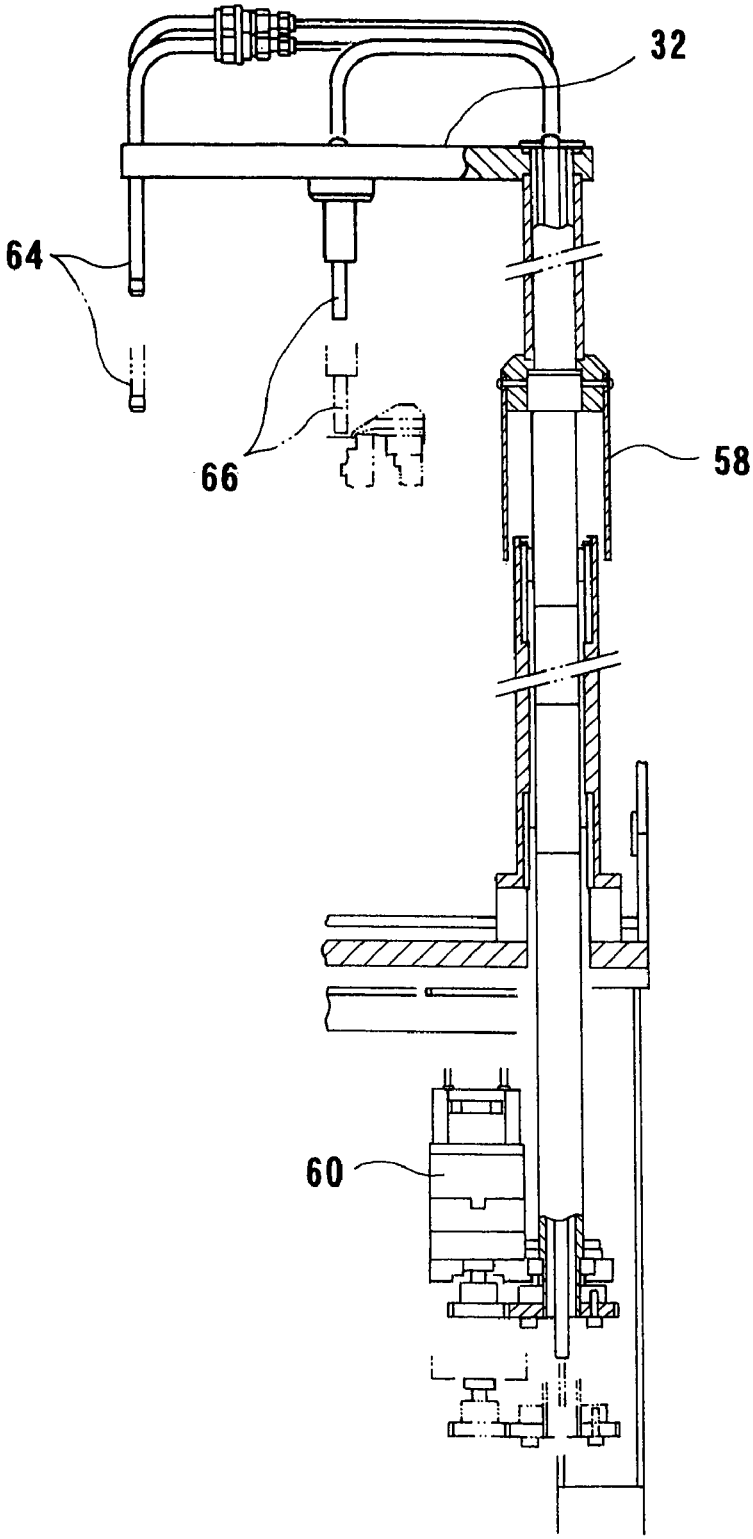
FIG. 4 is a front view of the pre-coating/recovering arm of the electrolytic processing apparatus.

As shown in FIG. 4, the pre-coating/recovering arm 32 is coupled to an upper end of a vertical support shaft 58. The pre-coating/recovering arm 32 is swingable by a rotary actuator 60 and is also vertically moveable by an air cylinder (not shown). The pre-coating/recovering arm 32 supports a pre-coating nozzle 64 for discharging a pre-coating liquid, on its free end, and an electrolytic solution recovering nozzle 66 for recovering the electrolytic solution, on a portion closer to its proximal end. The pre-coating nozzle 64 is connected to a syringe that is actuatable by an air cylinder, for example, for intermittently discharging a pre-coating liquid from the pre-coating nozzle 64. The electrolytic solution recovering nozzle 66 is connected to a cylinder pump or an aspirator, for example, to draw the electrolytic solution on the substrate from the electrolytic solution recovering nozzle 66.

Figure 5:
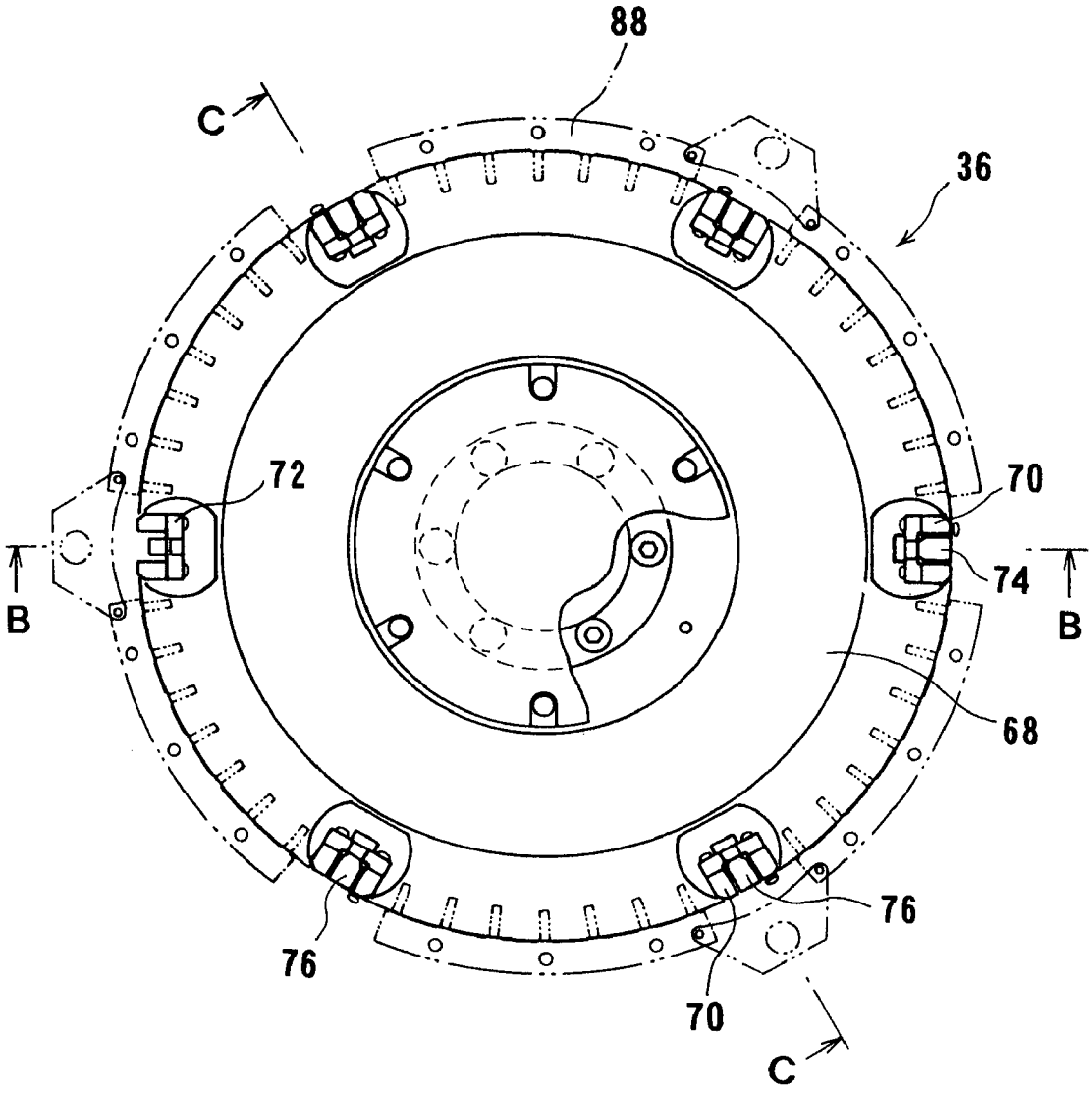
FIG. 5 is a plan view of the substrate holder.
Figure 6:
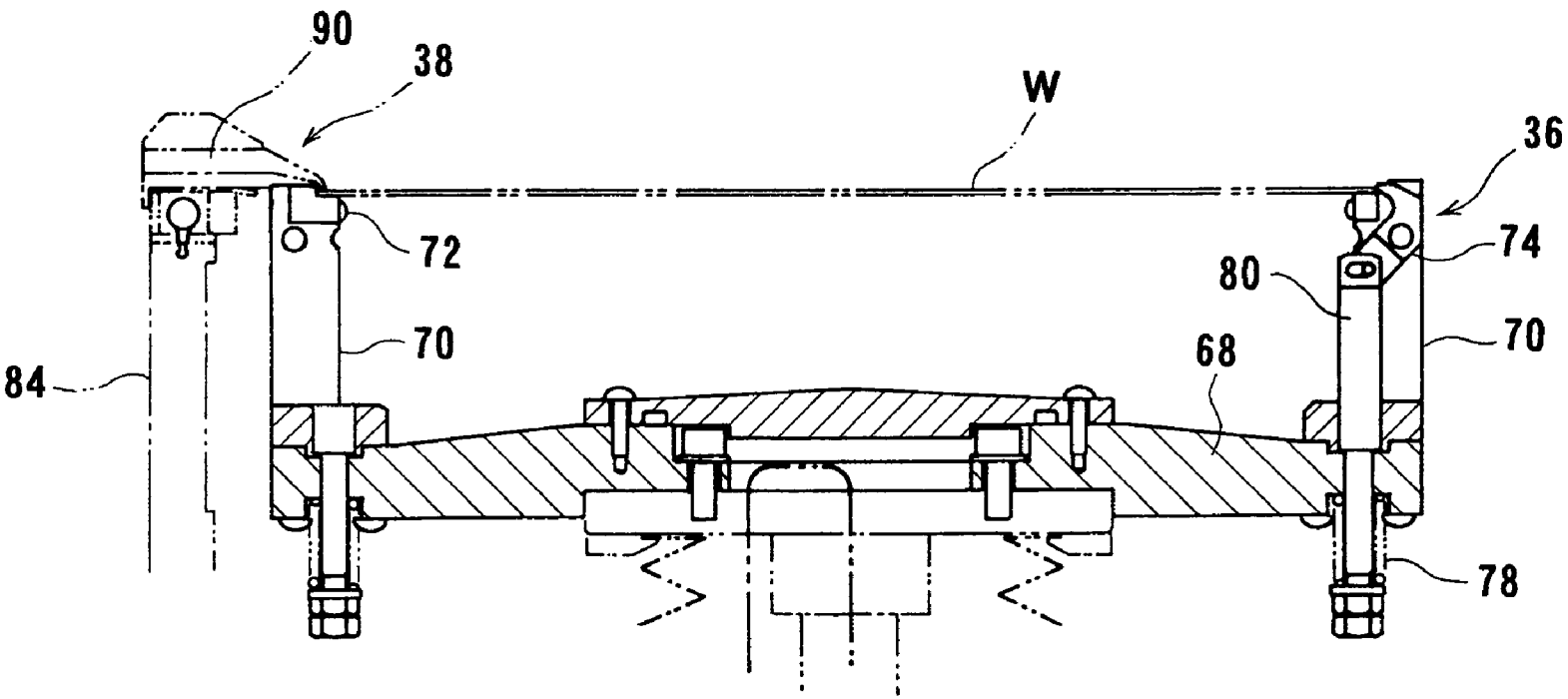
FIG. 6 is a sectional view taken along the line B-B of FIG. 5.
Figure 7:
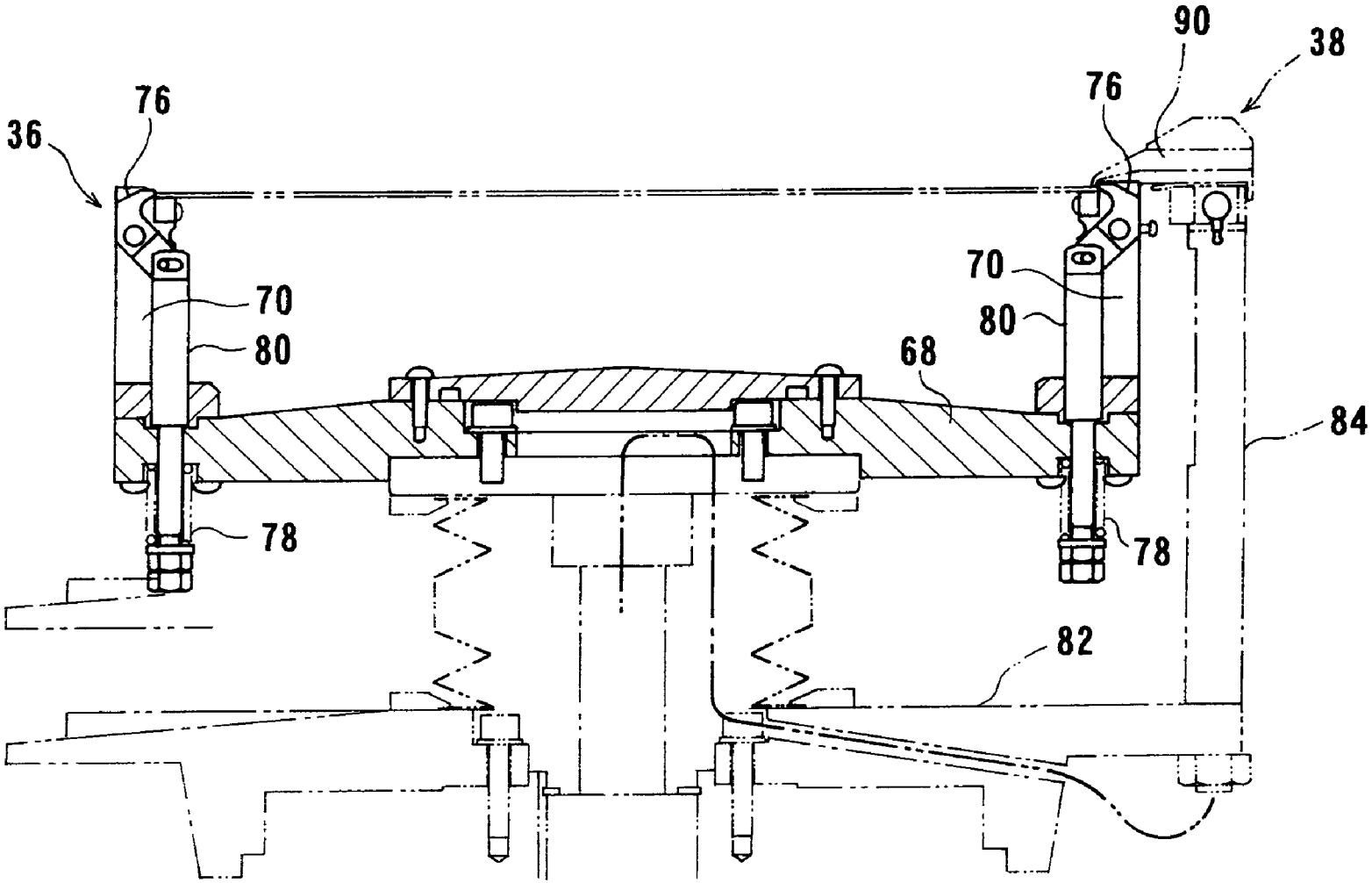
FIG. 7 is a sectional view taken along the line C-C of FIG. 5.

As shown in FIGS. 5 through 7, the substrate holder 36 has a disk-shaped substrate stage 68 and six vertical support arms 70 disposed at spaced intervals on the circumferential edge of the substrate stage 68 for holding a substrate W in a horizontal plane on respective upper surfaces of the support arms 70. A positioning plate 72 is mounted on an upper end of one of the support arms 70 for positioning the substrate by contacting the end face of the substrate. A pressing finger 74 is rotatably mounted on an upper end of the support arm 70, which is positioned opposite to the support arm 70 having the positioning plate 72, for abutting against an end face of the substrate W and pressing the substrate W to the positioning plate 72 when rotated. Chucking fingers 76 are rotatably mounted on upper ends of the remaining four support arms 70 for pressing the substrate W downwardly and gripping the circumferential edge of the substrate W.

The pressing finger 74 and the chucking fingers 76 have respective lower ends coupled to upper ends of pressing pins 80 that are normally urged to move downwardly by coil springs 78. When the pressing pins 80 are moved downwardly, the pressing finger 74 and the chucking fingers 76 are rotated radially inwardly into a closed position. A support plate 82 is disposed below the substrate stage 68 for engaging lower ends of the opening pins 80 and pushing them upwardly.

When the substrate holder 36 is located in the substrate transfer position A shown in FIG. 3, the pressing pins 80 are engaged and pushed upwardly by the support plate 82, so that the pressing finger 74 and the chucking fingers 76 rotate outwardly and open. When the substrate stage 68 is elevated, the opening pins 80 are lowered under the resiliency of the coil springs 78, so that the pressing finger 74 and the chucking fingers 76 rotate inwardly and close.

Figure 8:
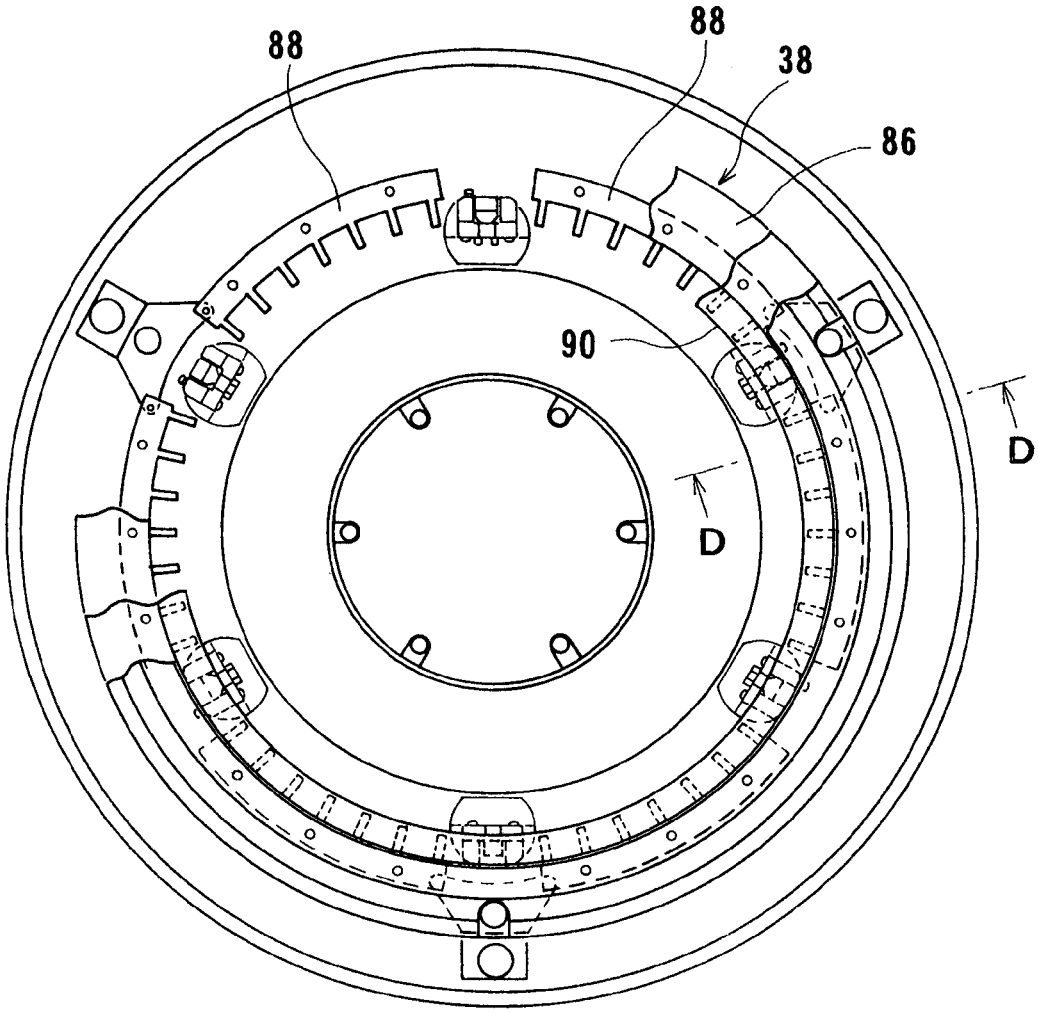
FIG. 8 is a plan view of the electrode portion.
Figure 9:
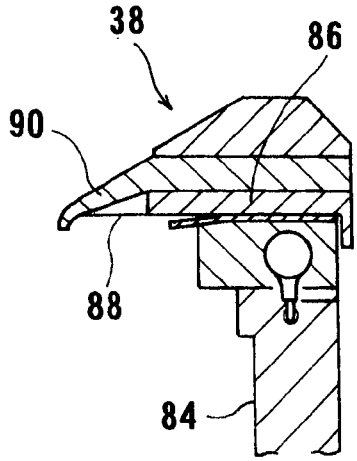
FIG. 9 is a sectional view taken along the line D-D of FIG. 8.

As shown in FIGS. 8 and 9, the electrode portion 38 comprises an annular frame 86 fixed to upper ends of vertical support columns 84 mounted on the peripheral edge of the support plate 82 (see FIG. 7), a plurality of, six in this embodiment, first electrodes 88 attached to a lower surface of the annular frame 86 and projecting inwardly, and an annular sealing member 90 mounted on an upper surface of the annular frame 86 in covering relation to upper surfaces of the first electrodes 88. The first electrodes 88 become a cathode during electroplating, and become an anode during electrolytic etching. The sealing member 90 is adapted to have an inner peripheral edge portion inclined inwardly downwardly and progressively thin-walled, and to have an inner peripheral end suspending downwardly.

When the substrate holder 36 has ascended to the electrolytic processing position B, as shown FIG. 3, the first electrodes 88 are pressed against the peripheral edge portion of the substrate W held by the substrate holder 36 for thereby allowing electric current to pass through the substrate W. At the same time, an inner peripheral end portion of the sealing member 90 is brought into contact with an upper surface of the peripheral edge of the substrate W under pressure to seal its contact portion in a watertight manner. As a result, the electrolytic solution supplied onto the upper surface (processing surface) of the substrate W is prevented from seeping from the end portion of the substrate W, and the electrolytic is prevented from contaminating the first electrodes 88.

In the present embodiment, the electrode portion 38 is vertically immovable, but rotatable in a body with the substrate holder 36. However, the electrode portion 38 may be arranged such that it is vertically movable and the sealing member 90 is pressed against the surface, to be processed, of the substrate W when the electrode portion 38 is lowered.

Figure 10:
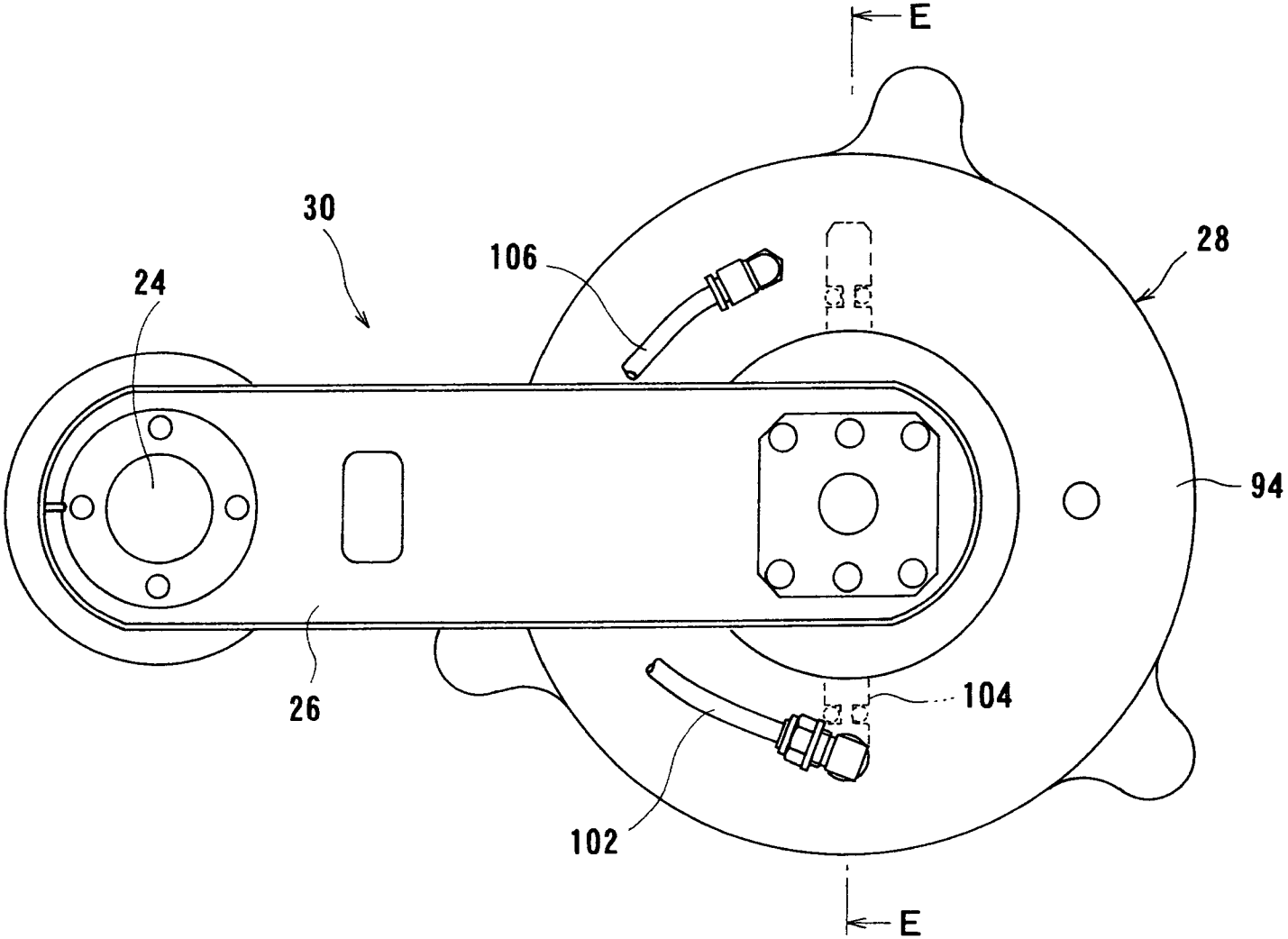
FIG. 10 is a plan view of the electrode arm section of the electrolytic processing apparatus.
Figure 11:
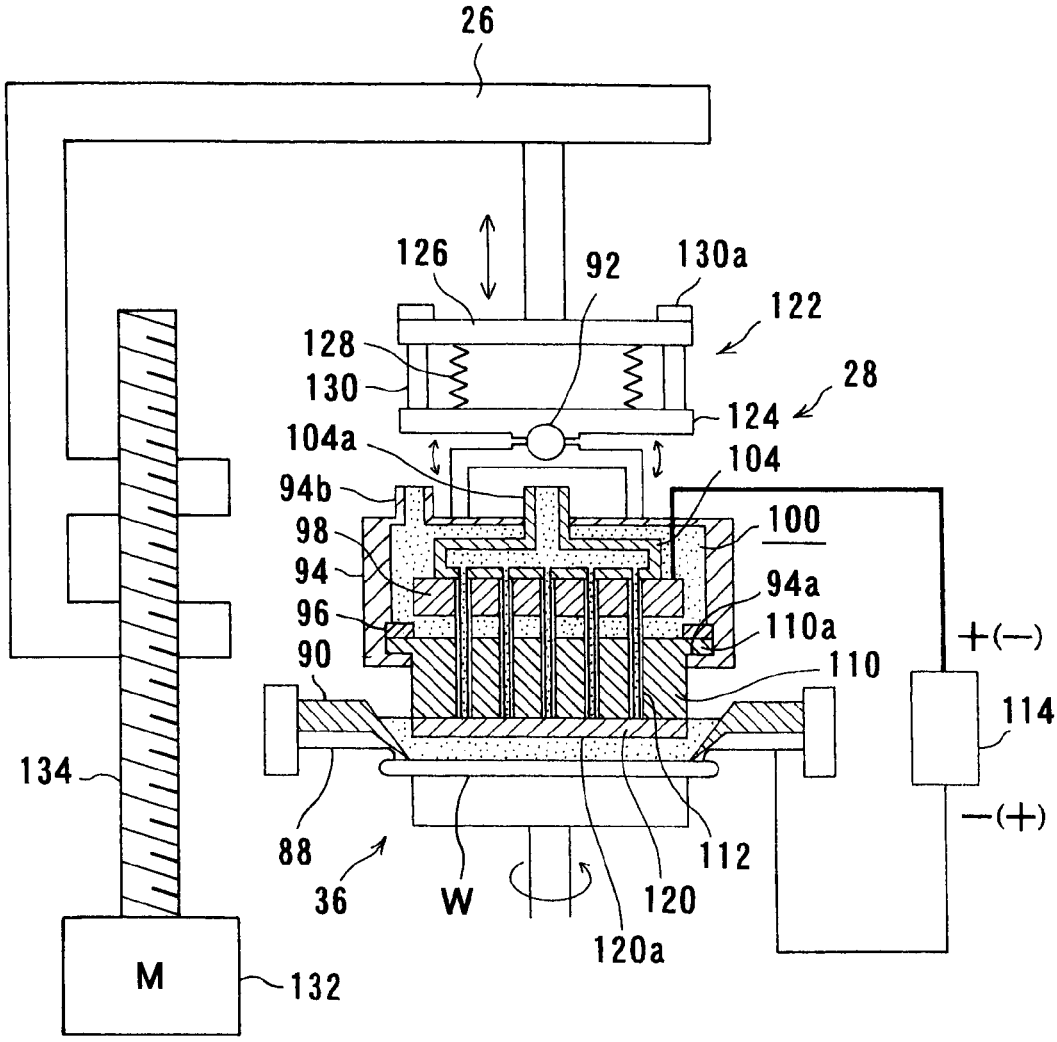
FIG. 11 is a schematic cross-sectional view illustrating the electrode head and the substrate holder of the electrolytic processing apparatus upon electroplating.
Figure 12:
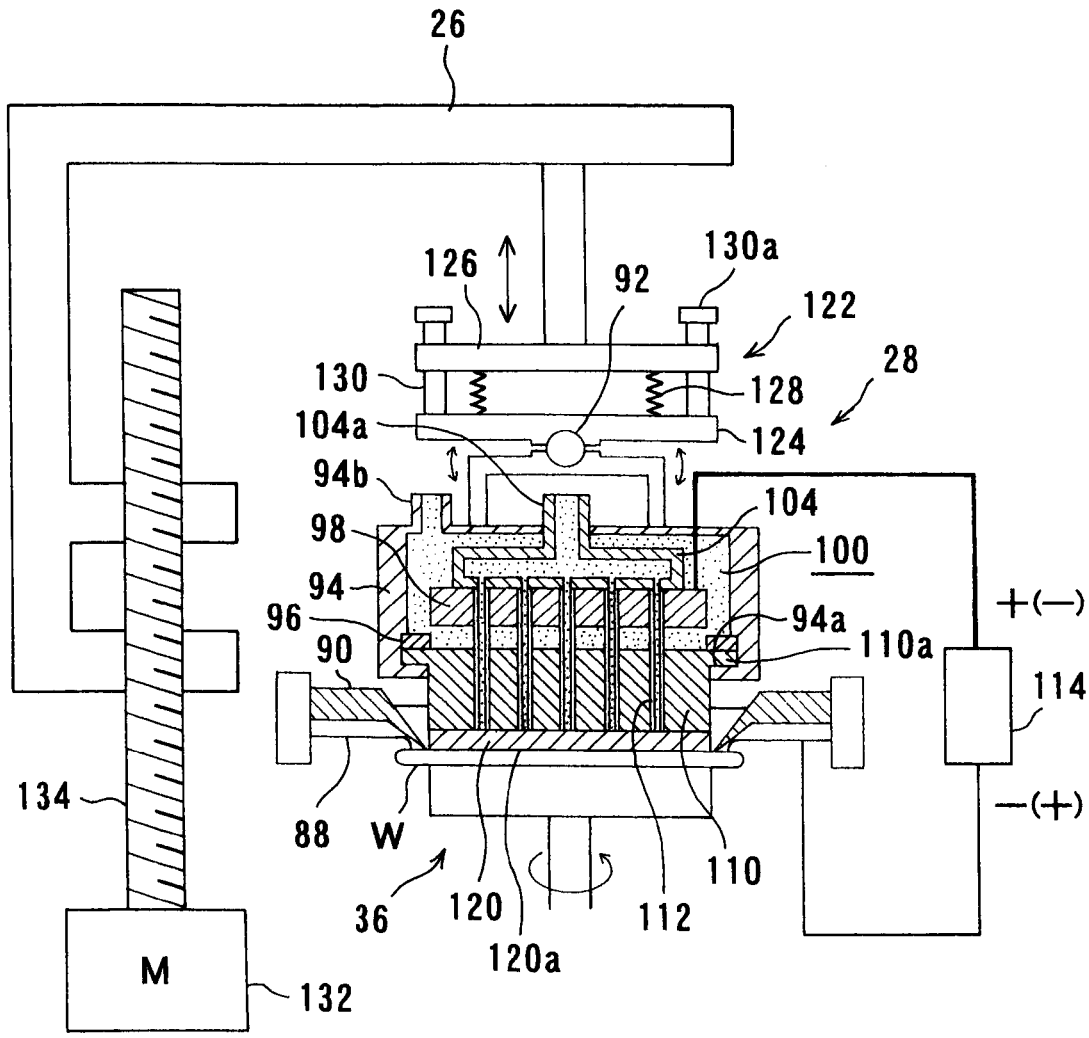
FIG. 12 is a schematic cross-sectional view illustrating the electrode head and the substrate holder of the electrolytic processing apparatus upon electrolytic etching.

As shown in FIGS. 10 through 12, the electrode head 28 of the electrode arm section 30 includes a housing 94 which is coupled via a ball bearing 92 to the free end of the pivot arm 26, and a high resistance structure 110 which is disposed such that it closes the bottom opening of the housing 94. The housing 94 has at its lower end an inwardly-projecting portion 94*a*, while the high resistance structure 110 has at its top a flange portion 110*a*. The flange portion 110*a* is engaged with the inwardly-projecting portion 94*a* and a space 96 is interposed as shown in FIGS. 11 and 12. The high resistance structure 110 is thus held with the housing 94, while a hollow electrolytic solution chamber 100 is defined in the housing 94.

The high resistance structure 110 is composed of porous ceramics such as alumina, SiC, mullite, zirconia, titania or cordierite, or a hard porous material such as a sintered compact of polypropylene or polyethylene, or a composite material comprising these materials. In case of the alumina-based ceramics, for example, the ceramics with a pore diameter of 30 to 200 μm is used. In case of the SiC, SiC with a pore diameter of not more than 30 μm, a porosity of 20 to 95%, and a thickness of about 1 to 20 mm, preferably 5 to 20 mm, more preferably 8 to 15 mm, is used. The high resistance structure 110, in this embodiment, is constituted of porous ceramics of alumina having a porosity of 30%, and an average pore diameter of 100 μm. The porous ceramic plate per se is an insulator, but the high resistance structure is constituted by causing the electrolytic solution to enter its interior complicatedly and follow a considerably long path in the thickness direction.

Figure 22A:
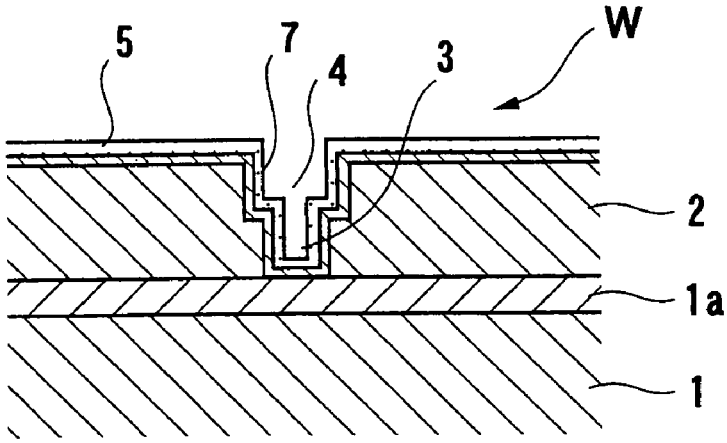
FIGS. 22A through 22C are diagrams illustrating, in sequence of process steps, an example of the formation of copper interconnects by plating.
Figure 22B:
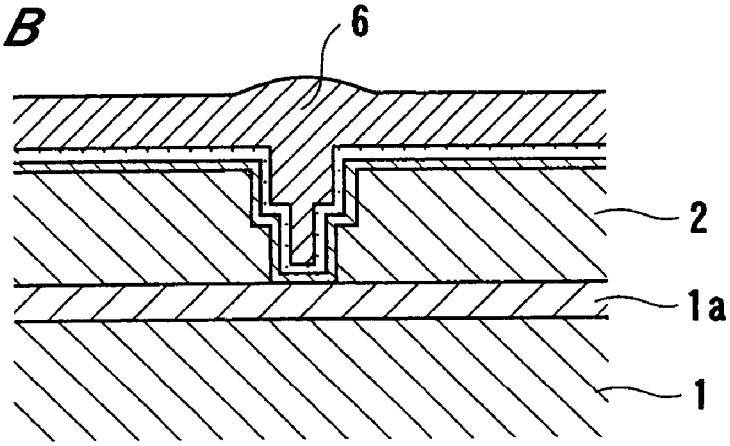
Figure 22C:
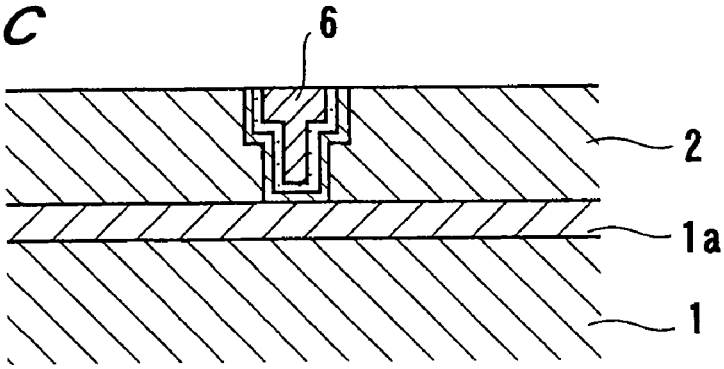
Figure 23:
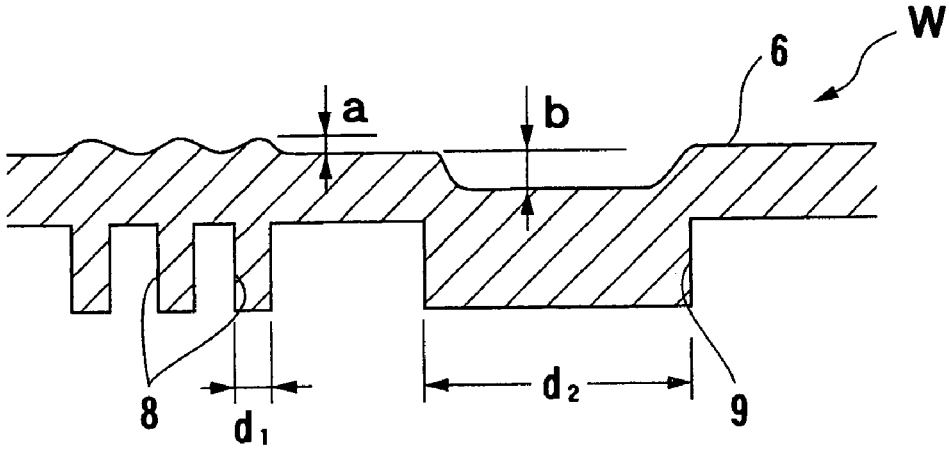
FIG. 23 is a diagram illustrating the prior art problem of uneven plating as observed in carrying out copper plating for the formation of embedded interconnects onto a substrate having fine grooves and large grooves in the surface.

The high resistance structure 110, which has the high resistance, is disposed in the electrolytic solution chamber 100. Hence, the influence of the resistance of the seed layer 7 (see FIG. 22) becomes a negligible degree. Consequently, the difference in current density over the surface of the substrate due to electrical resistance on the surface of the substrate W becomes small, and the uniformity of the plated film over the surface of the substrate improves.

In the electrolytic solution chamber 100, there is disposed a diametrically extending electrolytic solution introduction pipe 104 connected to a electrolytic solution supply pipe 102 which extends from the electrolytic solution supply unit 18 (see FIG. 1), and held in abutment against an upper surface of a second electrode 98 which becomes an anode during electroplating and a cathode during electrolytic etching. An electrolytic solution discharge pipe 106 communicating with the electrolytic solution chamber 100 is connected to the housing 94.

A manifold structure is employed for the electrolytic solution introduction pipe 104 so that the electrolytic solution can be supplied uniformly onto the processing surface of the substrate. In particular, a large number of narrow tubes 112, communicating with the electrolytic solution introduction pipe 104, are connected to the pipe 104 at predetermined positions along the long direction of the pipe 104. Further, small holes are provided in the second electrode 98 and the high resistance structure 110 at positions corresponding to the narrow tubes 112. The narrow tubes 112 extend downwardly in the small holes and reach the lower surface or its vicinity of the high resistance structure 110.

Thus, the electrolytic solution, introduced from the electrolytic solution supply pipe 102 into the electrolytic solution introduction pipe 104, passes through the narrow tubes 112 and reaches the bottom of the high resistance structure 110, and pass through the high resistance structure 110 and fills the electrolytic solution chamber 100, whereby the second electrode 98 is immersed in the electrolytic solution. The electrolytic solution is discharged from the electrolytic solution discharge pipe 106 by application of suction to the electrolytic solution discharge pipe 106.

In order to suppress slime formation, the second electrode 98 is made of copper (phosphorus-containing copper) containing 0.03 to 0.05% of phosphorus. It is also possible to use an insoluble material for the electrode.

The first electrodes 88 are electrically connected to one pole of a plating power source 114, and the second electrode 98 is electrically connected to the other pole of the plating power source 114. The plating power source 114 can change the direction of current flow.

A polishing pad 120 with the lower surface as a polishing surface 120*a* is mounted, e.g. by adhesion, to the lower surface of the high resistance structure 110. The polishing pad 120 is employed to rub the polishing surface 120*a* on the processing surface (plating surface) of the substrate W while pressing against the polishing surface 120*a* during electrolytic etching. The polishing pad 120 may be made of a flexible and durable woven fabric, non-woven fabric, resin or resin foam. It is desired that such a material have continuous pores that allows an electrolytic solution to pass therethrough. Specific examples of the polishing pad 120 include non-woven fabric Politex and foamed polyurethane IC1000, both available commercially from Rodel, Inc. and are widely used e.g. in CMP. The polishing pad 120 also includes PVD having flexibility and sponge and the like. In the case of a material having no continuous pores, it is possible to provide the polishing pad 120 with vertically-extending fine through-holes e.g. at 0.5-1 mm intervals, thereby allowing an electrolytic solution to pass through the polishing pad 120 to pass electricity therethrough.

Between the ball bearing 92 and the pivot arm 26 is provided a press mechanism 122 for pressing the polishing surface 120*a* of the polishing pad 120 against the processing surface of the substrate W. The press mechanism 122 includes a helical compression spring 128 disposed between a pair of plates 124, 126 spaced apart from each other, and a stopper 130 with one end fixed to one plate 124 and having at the other end a head portion 130*a* which makes contact with the other plate 126, thereby restricting the spacing between the plates 124, 126. The pivot arm 26 is vertically movable by a vertical movement motor 132, which is a servomotor, and a ball screw 134. It is also possible to use a compressed air actuator to constitute a vertical movement mechanism.

When the polishing surface 120*a* of the polishing pad 120 is not in contact with the surface of the substrate W, the electrode head 28 moves up and down (pivots), together with the pivot arm 26 via the elastic force of the helical compression spring 128. When the pivot arm 26 is lowered, the polishing surface 120*a* of the polishing pad 120 comes into contact with the surface of the substrate W. When the pivot arm 26 is further lowered, the helical compression spring 128 shrinks. The elastic force of the helical compression spring 128 acts on the polishing pad 120, pressing the polishing surface 120*a* against the surface of the substrate. The pressing force can be adjusted by adjusting the shrinkage (degree of displacement) of the helical compression spring 128. The pressing force is preferably not higher than 200 g/cm2, with about 70 g/cm2 being particularly preferred. The displacement and the elastic force of the spring may also be obtained by vertical movement of the pivot arm 26 by a compressed air actuator. Though in this embodiment the polishing pad 120 is moved vertically, it is possible to move the substrate holder 36 instead, or move both of them.

When carrying out electroplating, the first electrode 88 is made a cathode and the second electrode 98 is made an anode via the power source 114, and the substrate holder 36 is positioned at the electrolytic processing position B (see FIG. 3). As shown in FIG. 11, the electrode head 28 is lowered until the distance between the substrate W held by the substrate holder 36 and the polishing pad 120 becomes e.g. about 0.1 to 3 mm. An electrolytic solution (plating solution) is supplied from the electrolytic solution supply pipe 102 to the upper surface (processing surface) of the substrate W while impregnating the high resistance structure 110 with the electrolytic solution and filling the electrolytic solution chamber 100 with the electrolytic solution to carry out plating of the processing surface of the substrate W.

When carrying out electrolytic etching, on the other hand, the first electrode 88 is made an anode and the second electrode 98 is made a cathode via the power source 114, and the substrate holder 36 is positioned at the electrolytic processing position B (see FIG. 3). As shown in FIG. 12, the electrode head 28 is lowered until the polishing surface 120*a* of the polishing pad 120 comes to press against the substrate W held by the substrate holder 36 at a predetermined pressure. The electrolytic solution is supplied from the electrolytic solution supply pipe 102 to the upper surface (processing surface) of the substrate W while impregnating the high resistance structure 110 with the electrolytic solution and filling the electrolytic solution chamber 100 with the electrolytic solution. On the other hand, the substrate holder 36 is rotated so that the polishing surface 120*a* rubs against the processing surface (plating surface) of the substrate W. Electrolytic etching of the processing surface (plating surface) of the substrate W is thus effected.

The operation of the substrate processing apparatus incorporating the electrolytic processing apparatus of this embodiment will now be described by furthermore referring to FIGS. 13 and 14. According to this embodiment, electroplating and electrolytic etching are carried out by using the same electrolytic solution which may be, for example, an acidic plating solution, such as a copper sulfate plating solution, or a solution obtained by adding an acidic solution, such as sulfuric acid or nitric acid, to a plating solution containing an additive. It is, however, of course possible to carry out electroplating and electrolytic etching by using different electrolytic solutions. In that case, a liquid switching means, a liquid discharge mechanism, etc. are necessary.

First, a substrate W to be processed is taken out from one of the loading/unloading units 10 by the transfer robot 14, and transferred, with the surface to be processed facing upward, through the substrate carry-in and carry-out opening defined in the side panel, into one of the electrolytic processing apparatuses 12. At this time, the substrate holder 36 is in the lower substrate transfer position A. After the hand of the transfer robot 14 has reached a position directly above the substrate stage 68, the hand of the transfer robot 14 is lowered to place the substrate W on the support arms 70. The hand of the transfer robot 14 is then retracted through the substrate carry-in and carry-out opening.

After the hand of the transfer robot 14 is retracted, the cup 40 is elevated. Then, the substrate holder 36 is lifted from the substrate transfer position A to the pretreatment/cleaning position C. As the substrate holder 36 ascends, the substrate W placed on the support arms 70 is positioned by the positioning plate 72 and the pressing finger 74 and then reliably gripped by the fixing fingers 76.

On the other hand, the electrode head 28 of the electrode arm portion 30 is in a normal position over the electrolytic solution tray 22 now, and the high resistance structure 110 or the second electrode 98 is positioned in the electrolytic solution tray 22. At the same time that the cup 40 ascends, the electrolytic solution starts being supplied to the electrolytic solution tray 22 and the electrode head 28. Until the step of plating the substrate W is initiated, the new electrolytic solution is supplied, and the electrolytic solution discharge pipe 106 is evacuated to replace the electrolytic solution in the high resistance structure 110 and remove air bubbles from the electrolytic solution in the high resistance structure 110. When the ascending movement of the cup 40 is completed, the substrate carry-in and carry-out opening 50 in the side panel is closed by the cup 40, isolating the atmosphere in the side panel and the atmosphere outside of the side panel from each other.

When the cup 40 is elevated, the pre-coating step is initiated. Specifically, the substrate holder 36 that has received the substrate W is rotated, and the pre-coating/recovering arm 32 is moved from the retracted position to a position confronting the substrate W. When the rotational speed of the substrate holder 36 reaches a preset value, the pre-coating nozzle 64 mounted on the tip end of the pre-coating/recovering arm 32 intermittently discharges a pre-coating liquid which comprises a surface active agent, for example, toward the processing surface (plating surface) of the substrate W. At this time, since the substrate holder 36 is rotating, the pre-coating liquid spreads all over the processing surface of the substrate W. Then, the pre-coating/recovering arm 32 is returned to the retracted position, and the rotational speed of the substrate holder 36 is increased to spin the pre-coating liquid off and dry the processing surface of the substrate W.

After the completion of the pre-coating step, the plating step is initiated. First, the substrate holder 36 is stopped against rotation, or the rotational speed thereof is reduced to a preset rotational speed for plating. In this state, the substrate holder 36 is lifted to the electrolytic processing position B. Then, the peripheral edge of the substrate W is brought into contact with the first electrodes 88, when it is possible to pass an electric current, and at the same time, the sealing member 90 is pressed against the upper surface of the peripheral edge of the substrate W, thus sealing the peripheral edge of the substrate W in a water-tight fashion.

Based on a signal indicating that the pre-coating step for the loaded substrate W is completed, the electrode arm portion 30 is swung in a horizontal direction to displace the electrode head 28 from a position over the electrolytic solution tray 22 to a position over the electrolytic processing position. After the electrode head 28 reaches this position, the electrode head 28 is lowered toward the electrode portion 38. At this time, the high resistance structure 110 does not contact with the processing surface (plating surface) of the substrate W, but is held closely to the processing surface of the substrate W at a distance ranging from 0.1 mm to 3 mm. When the descent of the electrode head 28 is completed, a plating current is supplied such that the first electrode 88 becomes an cathode and the second electrode 98 becomes an anode, and the electrolytic solution is supplied from the electrolytic solution supply pipe 102 to the upper surface (processing surface) of the substrate W while impregnating the high resistance structure 110 with the electrolytic solution and filling the electrolytic solution chamber 100 with the electrolytic solution, whereby performing the plating of the processing surface of the substrate.

Figure 13:
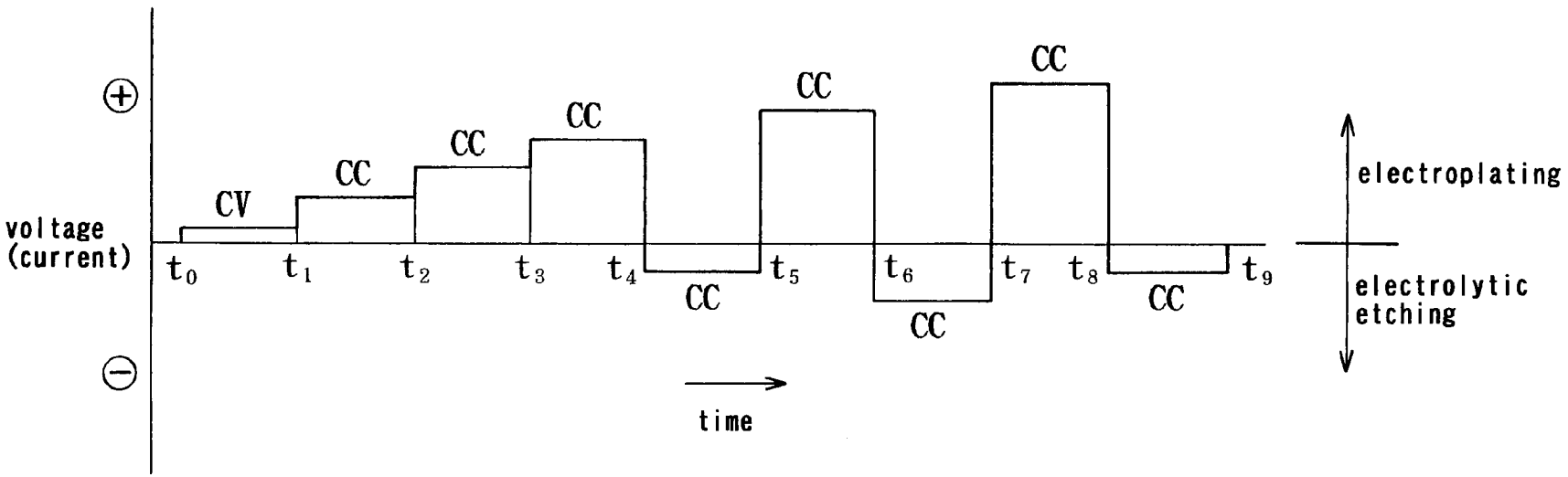
FIG. 13 is a graph showing an example of the relationship between electric current (voltage) and time in carrying out electroplating and electrolytic etching.
Figure 14:
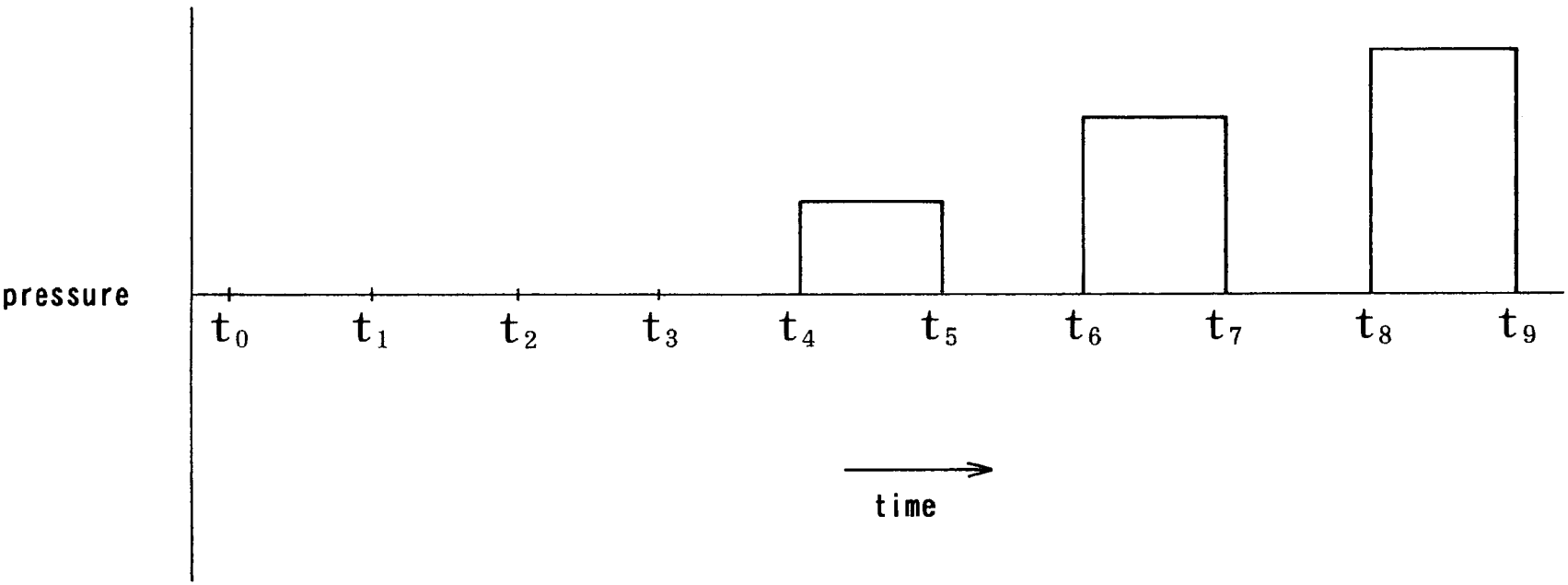
FIG. 14 is a graph showing an example of the relationship between pressing force (of a polishing pad to a substrate) and time in the electrolytic etching of FIG. 13.

During the plating, as shown in FIGS. 13 and 14, for example, the plating voltage is kept constant (CV control) until the filling of the solution ($t_0$-$t_1$). Thereafter, the electric current is increased stepwise while it is kept constant (CC control) in the respective step to carry out a first-step plating ($t_1$-$t_2$), a second-step plating ($t_2$-$t_3$) and a third-step plating ($t_3$-$t_4$). During the plating, according to necessity, the substrate holder 36 is rotated at a low speed.

Next, the electric current (voltage) is switched so that the first electrode 88 becomes an anode and the second electrode 98 becomes a cathode. While rotating the substrate holder 36, the polishing surface 120*a* of the polishing pad 120 is pressed at a predetermined pressure against the substrate W held by the substrate holder 36 so as to rub the polishing surface 120*a* against the processing surface (plating surface) of the substrate, thereby carrying out a first-step electrolytic etching ($t_4$-$t_5$).

Thereafter, the electric current (voltage) is switched so that the first electrode 88 becomes a cathode and the second electrode 98 becomes an anode, and the polishing pad 120 is returned to the position at which it is not in contact with the processing surface of the substrate W. A constant current, whose value is further increased from that of the third-step plating, is allowed to flow to carry out a fourth-step plating ($t_5$-$t_6$).

Next, the electric current (voltage) is switched in the above-described manner. A constant current, whose value is increased from that of the first-step etching, is allowed to flow to carry out a second-step electrolytic etching with an increased pressing force applied to the substrate ($t_6$-$t_7$).

The electric current (voltage) is then switched in the above-described manner, and the polishing pad 120 is returned to the position at which it is not in contact with the processing surface of the substrate W. A constant current, whose value is further increased from that of the fourth-step plating, is allowed to flow to carry out a fifth-step plating ($t_7$-$t_8$).

Thereafter, the electric current (voltage) is switched in the above-described manner. A constant current, whose value is decreased from that of the second-step etching, is allowed to flow to carry out a third-step electrolytic etching with an increased pressing force applied to the substrate ($t_8$-$t_9$), thereby completing electrolytic processing.

By thus carrying out electrolytic etching processings in the intervals between plating processings, and carrying out the electrolytic etching by pressing the polishing surface 120*a* against the processing surface (plating surface) of the substrate while moving the polishing surface 120*a* and the substrate W relative to each other, it becomes possible to selectively etch away raised portions in the plating film, which portions may be formed over fine grooves, thereby improving the flatness of the plated film.

When the electrolytic etching processing is completed, the electrode arm portion 30 is raised and then swung to return to the position above the electrolytic solution tray 22 and to lower to the ordinary position. Then, the pre-coating/recovering arm 32 is moved from the retreat position to the position confronting to the substrate W, and lowered to recover the remainder of the electrolytic solution on the substrate W by an electrolytic solution recovering nozzle 66. After recovering of the remainder of the electrolytic solution is completed, the pre-coating/recovering arm 32 is returned to the retreat position, and pure water is supplied from the fix nozzle 34 for supplying pure water toward the central portion of the substrate W for rinsing the plated surface of the substrate. At the same time, the substrate holder 36 is rotated at an increased speed to replace the electrolytic solution on the surface of the substrate W with pure water. Rinsing the substrate W in this manner prevents the splashing electrolytic solution from contaminating the first electrodes 88 of the electrode portion 38 during descent of the substrate holder 36 from the electrolytic processing position B.

After completion of the rinsing, the washing with water step is initiated. That is, the substrate holder 36 is lowered from the electrolytic processing position B to the pretreatment/cleaning position C. Then, while pure water is supplied from the fixed nozzle 34 for supplying pure water, the substrate holder 36 and the electrode portion 38 are rotated to perform washing with water. At this time, the sealing member 90 and the first electrodes 88 can also be cleaned, simultaneously with the substrate W, by pure water directly supplied to the electrode potion 38, or pure water scattered from the surface of the substrate W.

After washing with water is completed, the drying step is initiated. That is, supply of pure water from the fixed nozzle 34 is stopped, and the rotational speed of the substrate holder 36 and the electrode portion 38 is further increased to remove pure water on the surface of the substrate W by centrifugal force and to dry the surface of the substrate W. The sealing member 90 and the first electrodes 88 are also dried at the same time. Upon completion of the drying, the rotation of the substrate holder 36 and the electrode portion 38 is stopped, and the substrate holder 36 is lowered to the substrate transfer position A. Thus, the gripping of the substrate W by the fixing fingers 76 is released, and the substrate W is just placed on the upper surfaces of the support arms 70. At the same time, the cup 40 is also lowered.

All the steps including the electrolytic processing step, the pretreatment step accompanying to the electrolytic processing step, the cleaning step, and the drying step are now finished. The transfer robot 14 inserts its hand through the substrate carry-in and carry-out opening into the position beneath the substrate W, and raises the hand to receive the processed substrate W from the substrate holder 36. Then, the transfer robot 14 returns the processed substrate W received from the substrate holder 36 to one of the loading/unloading units 10.

Figure 15:
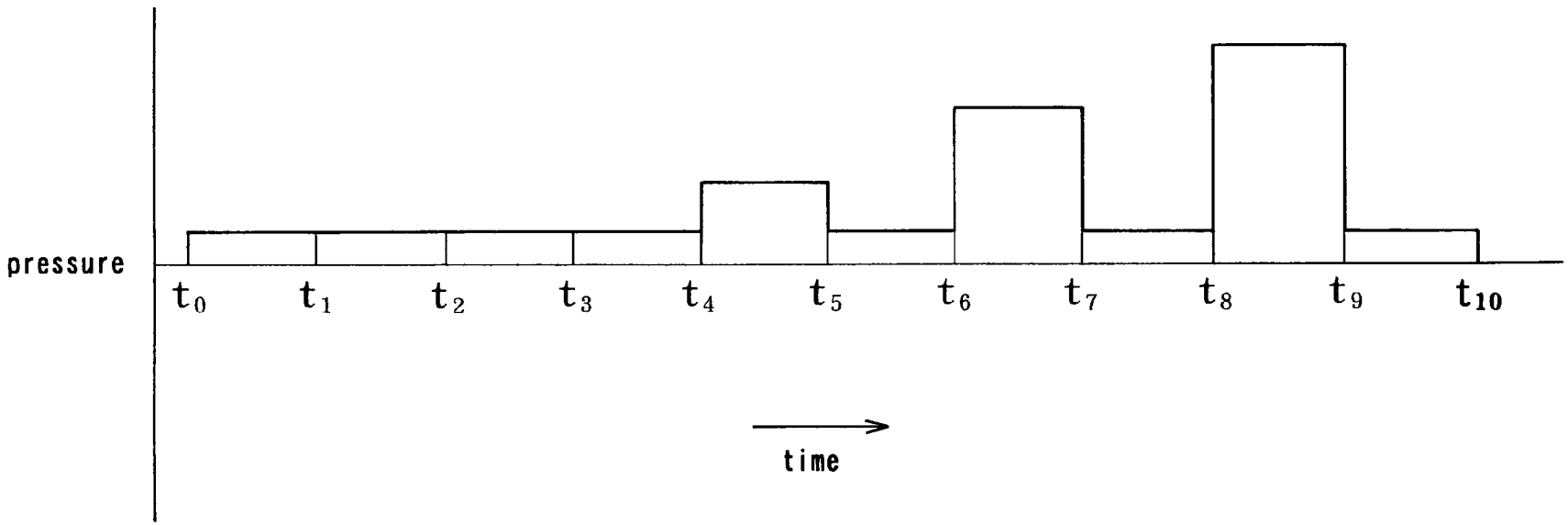
FIG. 15 is a graph showing an example of the relationship between pressing force (of a polishing pad to a substrate) and time in the electrolytic processing of FIG. 13 but carried out by applying a pressing force also in the electroplating.

According to this embodiment, the filling of solution and the respective step of plating are carried out while the polishing surface 120*a* of the polishing pad 120 and the processing surface (plating surface) of the substrate W are spaced by about 0.1 mm to 3 mm, i.e. they are not in contact with each other. However, it is also possible to carry out the filling of solution and the respective step of plating while the polishing surface 120*a* of the polishing pad 120 is in contact with the processing surface (plating surface) of the substrate W at a low pressure, as shown in FIG. 15. In particular, in this embodiment, the filling of solution ($t_0$-$t_1$), the first to third steps of plating ($t_1$-$t_4$), the fourth-step plating ($t_5$-$t_6$) and the fifth-step plating ($t_7$-$t_8$) are carried out while allowing the polishing surface 120*a* of the polishing pad 120 and the processing surface (plating surface) of the substrate W to be in contact with each other at a low pressure. After completion of the third-step electrolytic etching ($t_8$-$t_9$), the pressure between the polishing surface 120*a* of the polishing pad 120 and the processing surface of the substrate W is returned to the low pressure ($t_9$-$t_{10}$). Thereafter, the polishing pad 120 is separated from the substrate W.

By thus carrying out the filling of solution and the respective step of plating while allowing the polishing surface 120*a* of the polishing pad 120 to be in contact with the processing surface (plating surface) of the substrate W, the formation of raised portions in the surface of plated film can be reduced.

Figure 16:
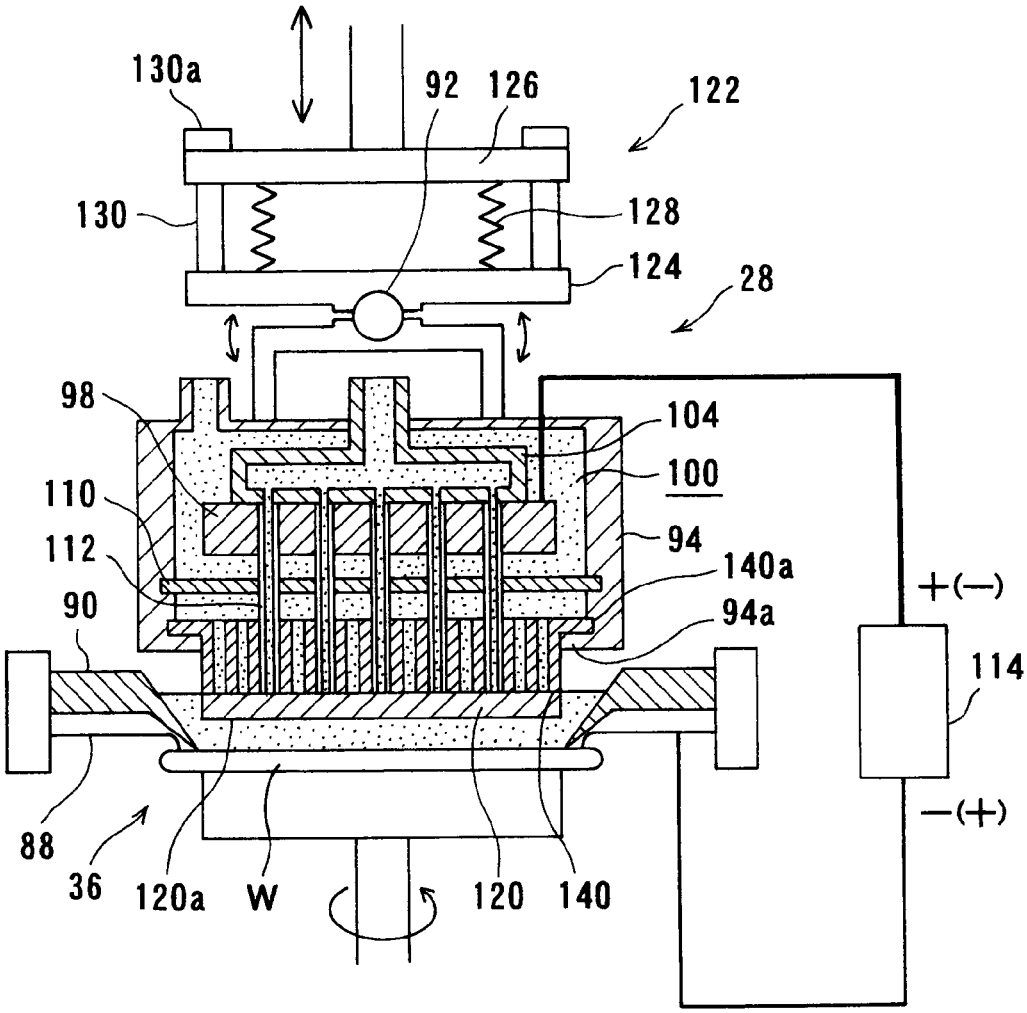
FIG. 16 is a schematic cross-sectional view corresponding to FIG. 11, showing the main portion of an electrolytic processing apparatus according to another embodiment of the present invention.
Figure 17:
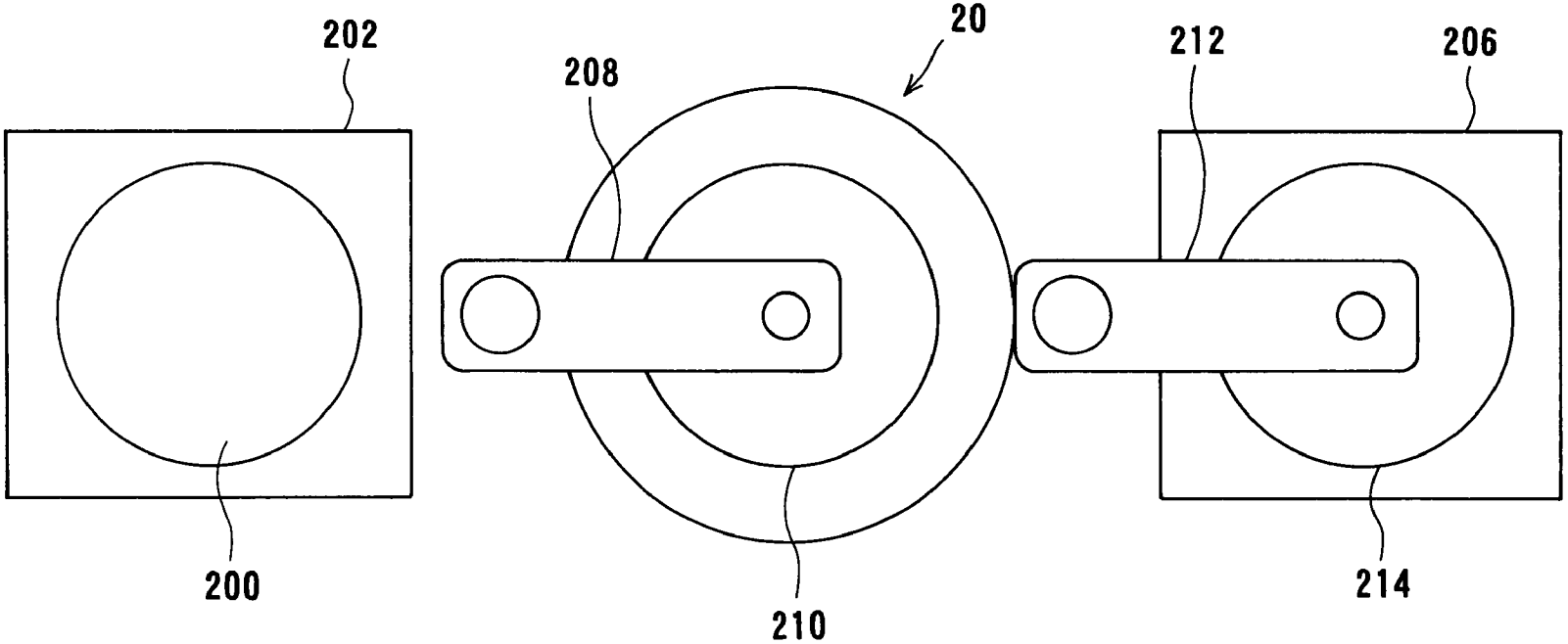
FIG. 17 is a schematic plan view illustrating an electrolytic processing apparatus according to yet another embodiment of the present invention upon electroplating.

FIG. 16 shows the main portion of an electrolytic processing apparatus according to another embodiment of the present invention. The apparatus of this embodiment differs from the apparatus of the preceding embodiment in that: a high resistance structure 110, extending laterally over the electrolytic solution chamber 100, is disposed within the chamber 100 with its peripheral portion held by the housing 94; a support 140 having a flange 140*a* is provided, and the support 140 is held by engagement of the flange 140*a* with the inwardly-projecting portion 94*a* of the housing 94; and the polishing pad 120 with the lower surface serving as the polishing surface 120*a* is mounted to the lower surface of the support 140. The thin tubes 112 vertically penetrate the support 140. Further, a large number of through-holes are formed in the support 140.

By thus holding the polishing pad 120 by the support 140 which may be of any material and any shape, the polishing pad 120 can be easily held and disposed in a predetermined position.

Though in the above-described embodiments use of the polishing pad 120 with the lower surface serving as the polishing surface 120*a*, it is possible to subject the high resistance structure to surface treatment, such as coating, firing or sealing, and utilize the lower surface of the thus-treated high resistance structure as a polishing surface.

FIGS. 17 through 20 show an electrolytic processing apparatus according to yet another embodiment of the present invention. The electrolytic processing apparatus of this embodiment, similarly to the preceding embodiments, includes a substrate processing section 20, including the substrate holder 36 for detachably holding a substrate W, and the electrode portion 38 having the first electrodes 88 and the sealing member 90. On the opposite sides of the substrate processing section 20 are disposed a first electrolytic solution tray (hereinafter referred to as plating solution tray) 202 holding a first electrolytic solution such as a plating solution (hereinafter referred to plating solution) 200 and a second electrolytic solution tray (hereinafter referred to as etching solution tray) 206 holding a second electrolytic solution such as an etching solution (hereinafter referred to as etching solution) 204.

The electrolytic processing apparatus also includes a first electrode head 210 which is held at the end of a vertically movable and pivotable arm 208 and pivots between the substrate processing section 20 and the plating solution tray 202, and a second electrode head 214 which is held at the end of a vertically movable and pivotable arm 212 and pivots between the substrate processing section 20 and the etching solution tray 206.

The first electrode head 210, similarly to the preceding embodiments, includes housing 216 and a high resistance structure 220 which closes the bottom opening of the housing 216 and defines an electrolytic solution chamber (plating solution chamber) 218. The electrolytic solution chamber 218 houses a second electrode 222 and can hold the plating solution 200 with the second electrode 222 immersed in the solution. On the other hand, the second electrode head 214 likewise includes a housing 224 and a high resistance structure 228 which closes the bottom opening of the housing 224 and defines an electrolytic solution chamber (etching solution chamber) 226. The electrolytic solution chamber 226 houses a second electrode 230 and can hold the etching solution 204 with the second electrode 230 immersed in the solution. A polishing pad 232 with the lower surface as a polishing surface 232*a* is attached to the lower surface of the high resistance structure 228 of the second electrode head 214. Further, though not shown diagrammatically, the second electrode head 214 is provided with a press mechanism for pressing on the high resistance structure 228 downwardly.

According to this embodiment, the first electrode head 210 for use in electroplating of the processing surface (plating surface) of a substrate, unlike the second electrode head 214 for electrolytic etching, does not have a polishing pad or the like. It is, however, possible to use as the first electrode head one having the same construction as the second electrode head 214 and use such a first electrode, for example, for carrying out electrolytic etching, or carrying out electroplating while allowing a polishing surface to be in contact with the processing surface of a substrate. Likewise, it is possible to use as the second electrode head one having the same construction as the first electrode head 210 and use such a second electrode head, for example, for carrying out electroplating.

Further, though in this embodiment the first electrode 210 and the second electrode 214 are provided in order to prevent the respective electrolytic solutions from being mixed, it is possible to use a single electrode head, for example, one having the same construction as the second electrode head 214, so as to simplify the structure. It is, of course, possible to use three or more electrolytic solution trays and the corresponding number of electrode heads.

Figure 19:
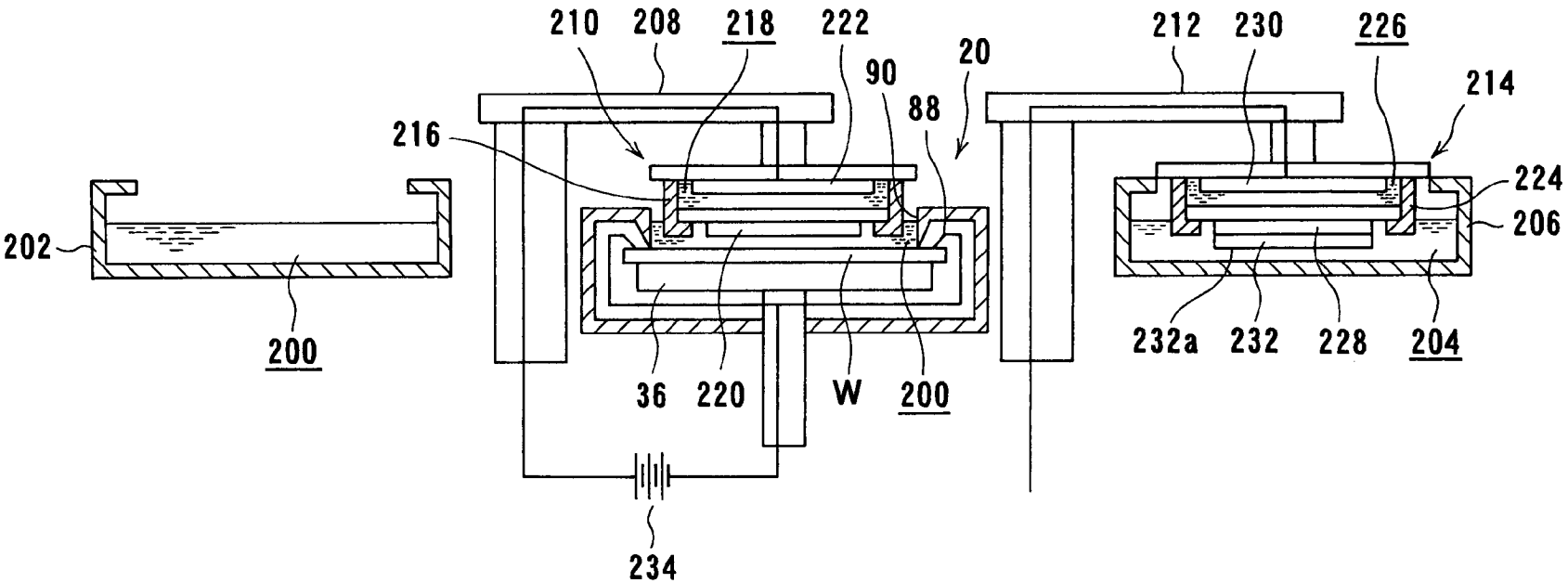
FIG. 19 is a vertical sectional view illustrating the electrolytic processing apparatus shown in FIG. 17 upon electroplating.
Figure 20:
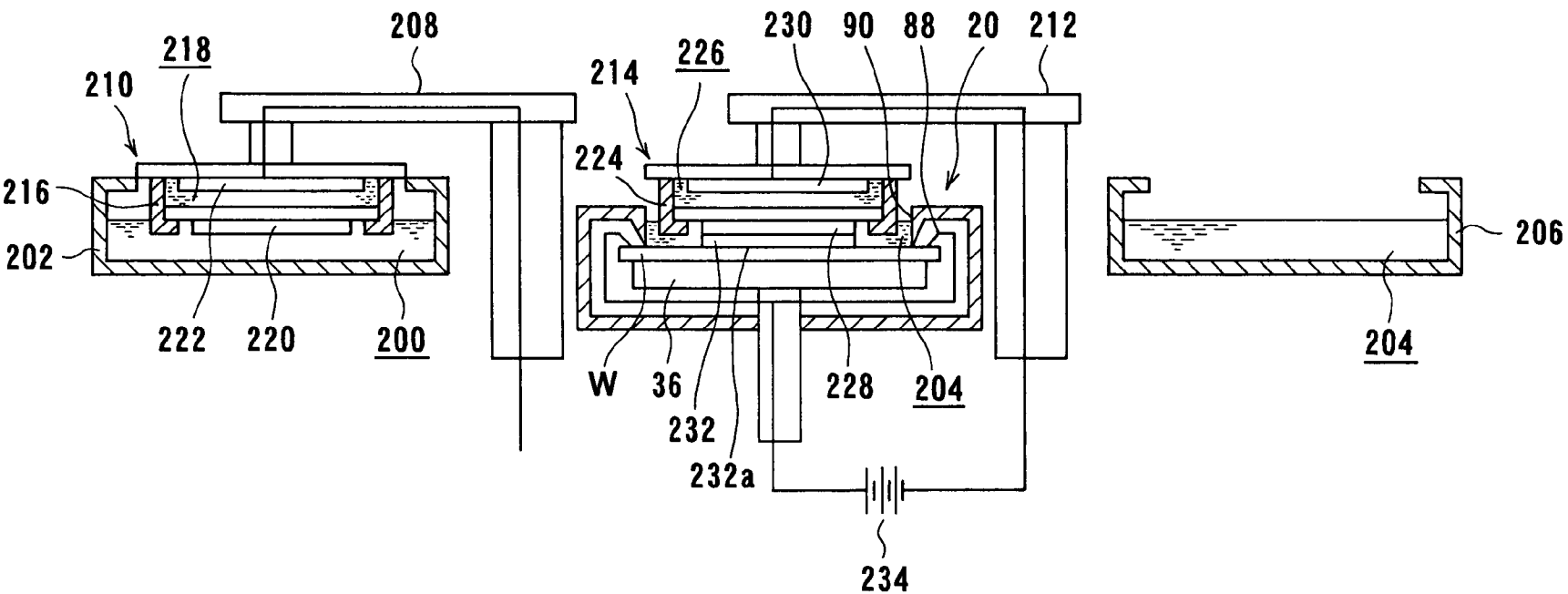
FIG. 20 is a vertical sectional view illustrating the electrolytic processing apparatus shown in FIG. 17 upon electrolytic etching.
Figure 21:
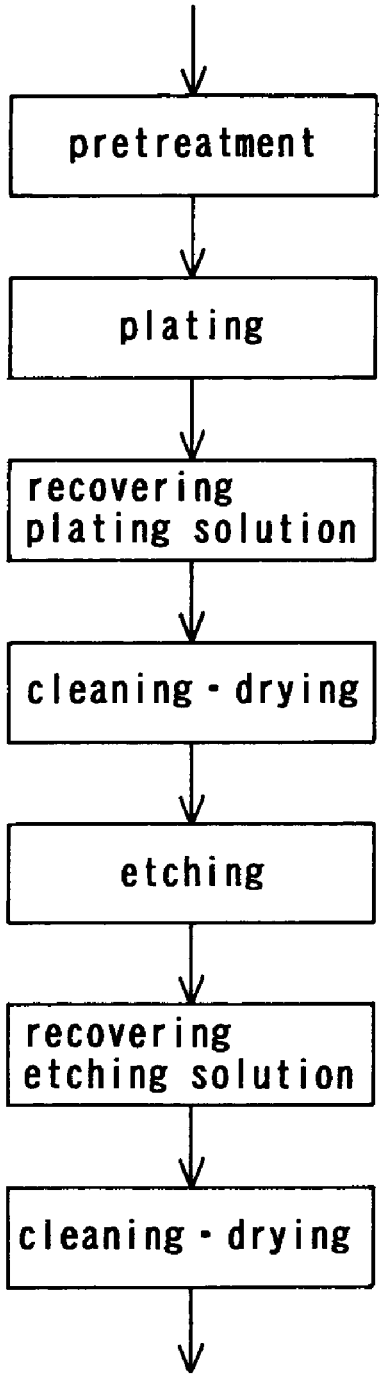
FIG. 21 is a block diagram showing a process flow of electrolytic processing performed by the electrolytic processing apparatus shown in FIG. 17.

A description will now be given of electrolytic processing performed by the electrolytic processing apparatus of this embodiment by referring to FIGS. 18 through 20 and also to FIG. 21.

First, as with the above-described embodiment, a substrate W is held with its processing surface facing upward by the substrate holder 36 of the substrate processing section 20. After carrying out a pre-plating treatment of the substrate W according to necessity, the first electrodes 88 are brought into contact with a peripheral portion of the substrate W so that electricity can be passed to the substrate, while the sealing member 90 is brought into pressure contact with a peripheral portion of the upper surface of the substrate W to water-tightly seal the peripheral portion.

Figure 18:
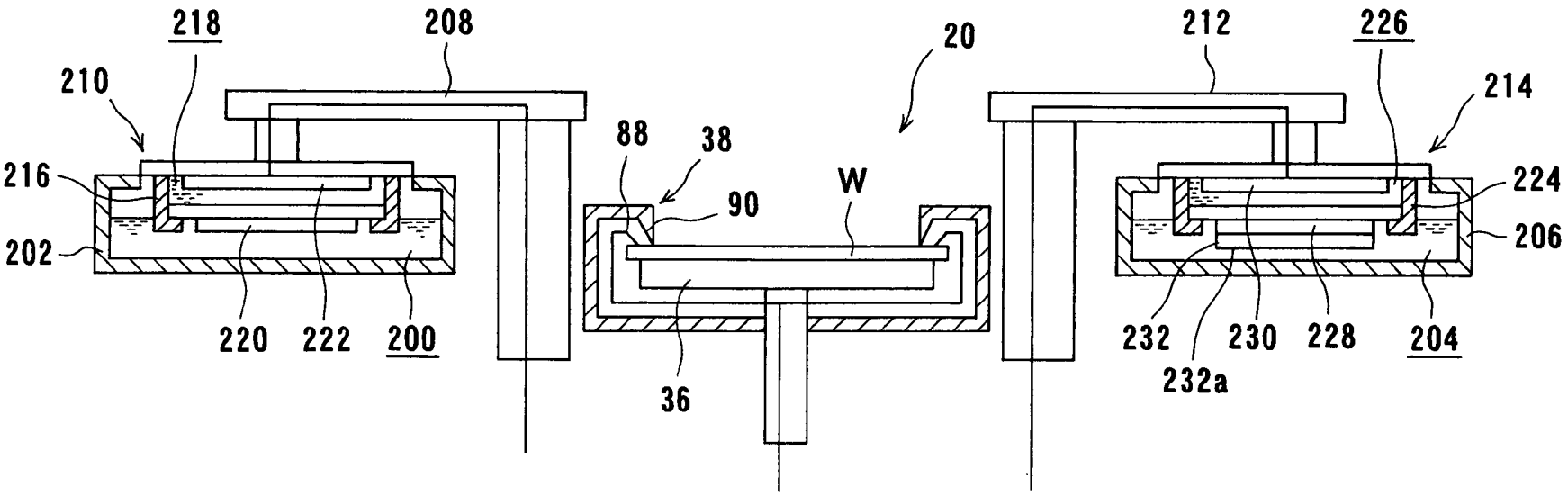
FIG. 18 is a vertical sectional view illustrating the electrolytic processing apparatus shown in FIG. 17 before carrying out electroplating and electrolytic etching.

As this moment, as shown in FIG. 18, the first electrode head 210 is in the normal position in the plating solution tray 202, the high resistance structure 220 is in contact with the plating solution 200 in the plating solution tray 202 and, by application of suction to the electrolytic solution chamber 218, the plating solution 200 is held within the high resistance structure 220 and in the electrolytic solution chamber 218. Similarly, the second electrode head 214 is in the normal position in the etching solution tray 206, the high resistance structure 228 is in contact with the etching solution 204 in the etching solution tray 206 and, by application of suction to the electrolytic solution chamber 226, the etching solution is held within the high resistance structure 228 and in the electrolytic solution chamber 226.

Thereafter, based on a signal indicating that the substrate W is set at a predetermined position, the first electrode head 210 holding the plating solution 200 inside is raised and then pivoted to a position right above the substrate holder 36. Next, the first electrode head 210 is lowered toward the substrate holder 36, and the lowering is stopped when the high resistance structure 220 has reached a position near the processing surface (plating surface) of the substrate W e.g. at a distance of about 0.1 mm to 3 mm. Thereafter, as shown in FIG. 19, the plating solution 200 is filled into the space between the high resistance structure 220 and the substrate W, while a plating current is applied from a power source 234 with the first electrode 88 as a cathode and the second electrode 222 as an anode and, according to necessity, the substrate W is rotated at a low speed, thereby carrying out electroplating of the processing surface (plating surface) of the substrate W.

After completion of the plating, the first electrode head 210 is raised and then pivoted to above the plating solution tray 202, and is then lowered to the normal position. Next, as with the above-described embodiment, the plating solution remaining on the substrate W is recovered by the electrolytic solution recovery nozzle. Thereafter, pure water is supplied to the plated surface of the substrate W to rinse (clean) the plated surface and replace the plating solution with pure water. Further, water-washing of the plated surface of the substrate W is carried out by supplying pure water to the plated surface while rotating the substrate W. After stopping the supply of pure water, the rotating speed of the substrate W is increased so as to drain water from the substrate surface by centrifugal force, thereby drying the substrate W.

Next, the second electrode head 214 holding the etching solution 204 inside is raised and then pivoted to a position right above the substrate holder 36. Next, the second electrode head 214 is lowered toward the substrate holder 36 so as to bring the polishing surface 232*a*, the lower surface of the polishing pad 232, into contact with the processing surface (plated surface) of the substrate W, and the lowering of the second electrode head 214 is stopped when the polishing surface 232*a* comes to press against the processing surface at a predetermined pressure. Thereafter, as shown in FIG. 20, the etching solution 204 is filled into the space between the high resistance structure 228 and the substrate W, while an electric current is applied from the power source 234 with the first electrode 88 as an anode and the second electrode 230 as a cathode, and the substrate W is rotated, thereby carrying out electrolytic etching of the processing surface (plated surface) of the substrate W.

After completion of the etching, the second electrode head 214 is raised and then pivoted to above the etching solution tray 206, and is then lowered to the normal position. Next, as with the above-described embodiment, the etching solution remaining on the substrate W is recovered by the electrolytic solution recovery nozzle. Thereafter, pure water is supplied to the plated surface of the substrate W to rinse (clean) the plated surface and replace the etching solution with pure water. Further, water-washing of the plated surface of the substrate W is carried out by supplying pure water to the plated surface while rotating the substrate W. After stopping the supply of pure water, the rotating speed of the substrate W is increased so as to drain water from the surface of the substrate by centrifugal force, thereby drying the substrate W.

The above electroplating and electrolytic etching are repeated according to necessity until the plated film on the substrate reaches a predetermined thickness. Thereafter, the substrate is sent to the next step.

According to this embodiment, the first electrolytic processing (e.g. plating) using the first electrolytic solution and the second electrolytic processing (e.g. etching) using the second electroplating can be carried out successively without mixing of the two electrolytic solutions while the substrate W is kept held by the substrate holder 36 without transfer of the substrate.

Though in this embodiment a plating solution is used as the first electrolytic solution and an etching solution is used as the second electrolytic solution to carry out plating and etching successively, it is also possible, for example, to use as the first electrolytic solution a plating solution having a high copper sulfate concentration and a low sulfuric acid concentration and having excellent embedding properties and use as the second electrolytic solution a plating solution having a low copper sulfate concentration and a high sulfuric acid concentration and having excellent plated film-flattening properties. Thus, two types of plating processings of a substrate using two plating solutions having different properties can be carried out successively while the substrate is kept held by the substrate holder.

Although certain preferred embodiments of the present invention have been shown and described in detail, it should be understood that various changes and modifications may be made therein without departing from the scope of the appended claims.

What is claimed is:

1. An electrolytic processing apparatus, comprising:

a substrate holder for holding a substrate;

a first electrode to make contact with the substrate for passing electricity to a processing surface of the substrate;

an electrode head including a high resistance structure and a second electrode, disposed opposite to and in this order from the substrate holder, and a polishing surface facing the processing surface of the substrate held by the substrate holder;

an electrolytic solution injection portion for injecting an electrolytic solution between the processing surface of the substrate held by the substrate holder and the second electrode;

a relative movement mechanism for moving the substrate holder and the electrode head relative to each other such that, during electroplating of the processing surface of the substrate, the substrate holder and the electrode head are arranged to provide a space between the processing surface of the substrate and the polishing surface, and such that, during electrolytic etching of the processing surface of the substrate, the substrate holder and the electrode head are arranged so that the polishing surface rubs the processing surface of the substrate;

a press mechanism including a compression spring arranged to apply a continuous elastic force between the relative movement mechanism and the electrode head so as to press the polishing surface of the electrode head against the substrate held by the substrate holder; and a power source for applying a voltage between the first electrode and the second electrode, the power source being capable of selectively switching the direction of electric current such that, during electroplating of the processing surface of the substrate, the first electrode serves as a cathode and the second electrode serves as an anode, and such that, during electrolytic etching of the processing surface of the substrate, the first electrode serves as an anode and the second electrode serves as a cathode;

wherein the relative movement mechanism includes a pivot arm operable to move vertically, the press mechanism further including a first plate attached to the pivot arm, and a second plate connected to the first plate by a stopper for guiding movement of the second plate relative to the first plate, the compression spring being arranged between the first plate and the second plate.

2. The electrolytic processing apparatus according to claim 1, wherein the polishing surface comprises an exposed surface of a polishing pad attached to the substrate-facing surface of the high resistance structure.

3. The electrolytic processing apparatus according to claim 2, wherein the polishing pad is made of a flexible and durable woven fabric, non-woven fabric, resin or resin foam.

4. The electrolytic processing apparatus according to claim 1, wherein the polishing surface comprises an exposed surface of a polishing pad supported by a support.

5. The electrolytic processing apparatus according to claim 4, wherein the polishing pad is made of a flexible and durable woven fabric, non-woven fabric, resin or resin foam.

6. The electrolytic processing apparatus according to claim 1, wherein the polishing surface comprises the lower surface of the high resistance structure which has undergone partial or entire modification or surface treatment.

7. The electrolytic processing apparatus according to claim 1, wherein the press mechanism is capable of adjusting a pressing force applied to the processing surface of the substrate by adjusting the biasing force of the compression spring.

8. The electrolytic processing apparatus according to claim 1, wherein the electrolytic solution is a plating solution or a solution of a plating solution containing an acidic solution.

9. The electrolytic processing apparatus according to claim 1, wherein the substrate holder is fixed in position, and the relative movement mechanism is connected to the electrode head so as to be operable to move the electrode head including the polishing surface toward and away from the substrate held by the stationary substrate holder.

10. The electrolytic processing apparatus according to claim 1, wherein the second plate of the press mechanism is connected to a housing of the electrode head by a ball bearing.

11. An electrolytic processing apparatus, comprising:

a substrate holder for holding a substrate with its processing surface facing upward;

a first electrode to make contact with the substrate for passing electricity to the processing surface of the substrate;

an electrode head including a high resistance structure and a second electrode disposed above the high resistance structure, both disposed above the substrate holder, and a polishing surface facing the processing surface of the substrate held by the substrate holder;

an electrolytic solution injection portion for injecting an electrolytic solution between the processing surface of the substrate held by the substrate holder and the second electrode;

a relative movement mechanism for moving the substrate holder and the electrode head relative to each other such that, during electroplating of the processing surface of the substrate, the substrate holder and the electrode head are arranged to provide a space between the processing surface of the substrate and the polishing surface, and such that, during electrolytic etching of the processing surface of the substrate, the substrate holder and the electrode head are arranged so that the polishing surface rubs the processing surface of the substrate;

a press mechanism including a compression spring arranged to apply a continuous elastic force between the relative movement mechanism and the electrode head so as to press the polishing surface of the electrode head against the substrate held by the substrate holder; and a power source for applying a voltage between the first electrode and the second electrode, the power source being capable of selectively switching the direction of electric current such that, during electroplating of the processing surface of the substrate, the first electrode serves as a cathode and the second electrode serves as an anode, and such that, during electrolytic etching of the processing surface of the substrate, the first electrode serves as an anode and the second electrode serves as a cathode;

wherein the relative movement mechanism includes a pivot arm operable to move vertically, the press mechanism further including a first plate attached to the pivot arm, and a second plate connected to the first plate by a stopper for guiding movement of the second plate relative to the first plate, the compression spring being arranged between the first plate and the second plate.

12. The electrolytic processing apparatus according to claim 11, wherein the polishing surface comprises an exposed surface of a polishing pad attached to the substrate-facing surface of the high resistance structure.

13. The electrolytic processing apparatus according to claim 12, wherein the polishing pad is made of a flexible and durable woven fabric, non-woven fabric, resin or resin foam.

14. The electrolytic processing apparatus according to claim 11, wherein the polishing surface comprises an exposed surface of a polishing pad supported by a support.

15. The electrolytic processing apparatus according to claim 14, wherein the polishing pad is made of a flexible and durable woven fabric, non-woven fabric, resin or resin foam.

16. The electrolytic processing apparatus according to claim 14, wherein the electrode head further includes a housing, the high resistance structure being arranged within a chamber and having a peripheral portion held by the housing under the second electrode, the support being arranged so as to close a lower opening of the housing, and the polishing pad being attached to a lower surface of the support.

17. The electrolytic processing apparatus according to claim 11, wherein the polishing surface comprises the lower surface of the high resistance structure which has undergone partial or entire modification or surface treatment.

18. The electrolytic processing apparatus according to claim 11, wherein the press mechanism is capable of adjusting a pressing force applied to the processing surface of the substrate by adjusting the biasing force of the compression spring.

19. The electrolytic processing apparatus according to claim 11, wherein the electrolytic solution is a plating solution or a solution of a plating solution containing an acidic solution.

20. The electrolytic processing apparatus according to claim 11, wherein the substrate holder is fixed in position, and the relative movement mechanism is connected to the electrode head so as to be operable to move the electrode head including the polishing surface toward and away from the substrate held by the stationary substrate holder.

21. The electrolytic processing apparatus according to claim 11, wherein the second plate of the press mechanism is connected to a housing of the electrode head by a ball bearing.

* * * * *